US008393716B2

(12) United States Patent
Tobita et al.

(10) Patent No.: US 8,393,716 B2
(45) Date of Patent: Mar. 12, 2013

(54) LIQUID EJECTION HEAD INCLUDING FLOW CHANNEL PLATE FORMED WITH PRESSURE GENERATING CHAMBER, METHOD OF MANUFACTURING SUCH LIQUID EJECTION HEAD, AND IMAGE FORMING APPARATUS INCLUDING SUCH LIQUID EJECTION HEAD

(75) Inventors: Satoru Tobita, Kanagawa (JP); Masayuki Kinoshita, Kanagawa (JP); Kaori Fujii, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 181 days.

(21) Appl. No.: 12/875,409

(22) Filed: Sep. 3, 2010

(65) Prior Publication Data

US 2011/0057992 A1 Mar. 10, 2011

(30) Foreign Application Priority Data

Sep. 7, 2009 (JP) ..... 2009-206379
Sep. 15, 2009 (JP) ..... 2009-212882
Jun. 26, 2010 (JP) ..... 2010-145710

(51) Int. Cl.
*B41J 2/045* (2006.01)

(52) U.S. Cl. ..... 347/68; 347/70; 347/93

(58) Field of Classification Search ..... 347/20, 347/44, 47, 56, 61–65, 67–68, 70–71, 92–94
See application file for complete search history.

(56) References Cited

U.S. PATENT DOCUMENTS 5,510,816 A * 4/1996 Hosono et al. ..... 347/70
6,328,418 B1 12/2001 Yamada et al.
6,499,836 B1 12/2002 Usui et al.
6,517,189 B2 2/2003 Ogawa et al.
6,719,411 B2 4/2004 Tomita et al.
6,761,436 B2 7/2004 Tobita et al.
7,077,511 B2 7/2006 Machida et al.
7,090,340 B2 8/2006 Tobita et al.
7,131,718 B2 11/2006 Matsufuji et al.
7,165,433 B2 1/2007 Akahane et al.
7,219,983 B2 5/2007 Akahane et al.
7,413,294 B2 8/2008 Tobita et al.
7,478,898 B2 1/2009 Yamada et al.
7,494,210 B2 2/2009 Yamada et al.
7,543,381 B2 6/2009 Ogawa et al.

(Continued)

FOREIGN PATENT DOCUMENTS

JP 4-39053 2/1992
JP 6-191043 7/1994

(Continued)

*Primary Examiner* — Juanita D Jackson
(74) *Attorney, Agent, or Firm* — Cooper & Dunham LLP

(57) ABSTRACT

A liquid ejection head is disclosed. The liquid ejection includes a flow channel plate, the flow channel plate being formed from one thin plate, the flow channel plate being formed with one or more pressure generating chambers, a fluid resistance section which supplies liquid to the pressure generating chamber, and a nozzle hole which opposes the pressure generating chamber. The flow channel plate is made of a metal material, and wherein the flow plate includes the pressure generating chamber which is formed of a groove-shaped indentation; the nozzle hole which is formed at one end in a longitudinal direction of the groove-shaped indentation; and the fluid resistance section which is formed at the other end in the longitudinal direction of the groove-shaped indentation. The pressure generating chamber, the nozzle head, and the fluid resistance section are formed such that they deform the thin plate in a thickness direction.

17 Claims, 29 Drawing Sheets

U.S. PATENT DOCUMENTS

| | | | |
|---|---|---|---|
| 7,669,329 | B2 | 3/2010 | Ogawa et al. |
| 2004/0174411 | A1 | 9/2004 | Sumiya et al. |
| 2006/0044364 | A1 | 3/2006 | Tobita et al. |
| 2006/0197809 | A1 | 9/2006 | Tobita et al. |
| 2006/0268072 | A1 | 11/2006 | Yamada et al. |
| 2007/0126802 | A1 | 6/2007 | Shingyohuchi |
| 2007/0132813 | A1 | 6/2007 | Yamada et al. |
| 2007/0195130 | A1 | 8/2007 | Koda et al. |
| 2008/0180469 | A1 | 7/2008 | Katayama |
| 2009/0058940 | A1 | 3/2009 | Fujii |
| 2010/0053269 | A1 | 3/2010 | Fujii et al. |

FOREIGN PATENT DOCUMENTS

| | | |
|---|---|---|
| JP | 7-156387 | 6/1995 |
| JP | 2000-263799 | 9/2000 |
| JP | 2002-113529 | 4/2002 |
| JP | 3495863 | 11/2003 |
| JP | 2004-153478 | 5/2004 |
| JP | 3654296 | 3/2005 |
| JP | 2006-61964 | 3/2006 |
| JP | 2006-68767 | 3/2006 |
| JP | 2006-88419 | 4/2006 |
| JP | 2006-20562 | 8/2006 |
| JP | 2007-144706 | 6/2007 |
| JP | 2007-152663 | 6/2007 |
| JP | 2008-74034 | 4/2008 |
| JP | 2008-100484 | 5/2008 |
| JP | 2008-132793 | 6/2008 |
| WO | WO2004/004943 | 1/2004 |

* cited by examiner

LIQUID EJECTION HEAD INCLUDING FLOW CHANNEL PLATE FORMED WITH PRESSURE GENERATING CHAMBER, METHOD OF MANUFACTURING SUCH LIQUID EJECTION HEAD, AND IMAGE FORMING APPARATUS INCLUDING SUCH LIQUID EJECTION HEAD

TECHNICAL FIELD

The present invention relates to liquid ejection heads, manufacturing methods thereof, and image forming apparatuses.

BACKGROUND ART

As an image forming device for a printer, a facsimile, a reproducing unit, a plotter, and a multifunctional unit having these functions, an inkjet recording device is known as a liquid ejection recording-type image forming device which uses a recording head including a liquid ejection head (a liquid droplet ejection head) that ejects an ink droplet, for example. The liquid ejection recording-type image forming device ejects an ink droplet from the recording head to a sheet to be conveyed (not limited to paper and includes an OHP sheet, representing what the ink droplet and other liquid, etc., can be adhered to; also called a medium to be recorded on, or a recording medium, recording paper, a recording sheet) to perform image forming (recording, print, imaging, printing also used interchangeably). The liquid ejection recording-type image forming device includes a serial-type image forming device which ejects liquid droplets while the recording head moves in a main scanning direction and a line-type image forming device with the use of a line-type head which ejects droplets while the recording head does not move to perform image forming.

Herein, a liquid ejection-type "image forming device" represents a device which ejects liquid to a medium such as paper, thread, fiber, cloth, leather, metal, plastic, glass, wood, ceramics, etc., while "image forming" represents not only providing a medium with an image which has a meaning (e.g., character or graphics), but also providing a medium with an image which does not have a meaning (merely causing a droplet to impact the medium. Moreover, "ink" is not limited to what is called ink, but all types of liquids which can perform image forming, such as what is called recording liquid, fixing solution, liquid, etc., and includes DNA sample, resist, pattern material, resin, etc., for example. Furthermore, "image" is not limited to a planar image (two-dimensional image), but also an image provided to what is formed three-dimensionally, and also an image formed by three-dimensionally shaping a solid itself.

There is known a liquid ejection head such that a nozzle plate having multiple nozzle holes (also called nozzles, nozzle openings, orifices, ejection ports, etc.); a flow channel plate (also called a chamber plate, etc.) including pressure generating chambers (also called pressure chambers, liquid chambers, pressurizing liquid chambers, an individual liquid chamber, etc.), each of which communicates with the corresponding nozzles and a fluid resistance section which supplies ink to each of the pressure generating chambers; and a vibrating plate member which forms wall faces of the pressure generating chamber, the fluid resistance section, etc. that are adhesively joined, and a vibrating plate which forms the wall face of the pressure generating chamber that is deformed by a pressure generating unit such as a piezoelectric element to change the volume within the pressure generating chamber, thus causing liquid droplets to be ejected from the nozzle holes (Patent document 1).

Due to the need for stabilizing the liquid droplet in order to obtain a higher image quality, positional accuracy and shape accuracy of the above-described nozzle holes of the liquid ejection head, which holes are formed at a pitch of print resolution, or a pitch of ⅓ to ½ thereof, need to be made high.

As a related art method of manufacturing the nozzle plate, a method is known to form a tapered cross-sectional shape by form rolling by punching a thin metal plate and then grind and form a tip portion to be a nozzle hole.

Moreover, as a method of manufacturing the flow channel plate, there is a method of accurately processing a pressure generating chamber by isotropic etching using monocrystalline silicon (Patent document 3). However, when the size of a head exceeds one inch, there is a problem that material cost increases. Moreover, when the flow channel plate formed of a silicon material is bonded with the nozzle plate formed by the above-mentioned processing method, for example, when hardening is done at high temperature as it is to be done in a short time, since linear expansion coefficients of the materials are different, a problem of a mismatch in opposing positions of the respective plates, warping, or, possibly cracking of the silicon material occurs, so that an adhesive which hardens at room temperature must be used, leading to a problem that the process of manufacturing the head takes time.

Thus, it is known to form the flow channel plate by forming a through hole on a metal thin plate by etching (Patent document 4), or to form, by press working, a pressure generating chamber in a narrow and long groove (Patent document 5), or to form, using press working, an ink flow channel hole to be a pressure generating chamber (Patent document 6). The above-described methods of manufacturing make it possible to form the nozzle plate, the flow channel plate, and the vibrating plate member all with the same material, for example, a stainless steel thin plate, for example.

Moreover, if an air bubble remains within a common liquid chamber (common liquid flow channel) which supplies liquid to the nozzle, the individual liquid chamber, and multiple individual liquid chambers when the liquid is filled or supplied into the head, it is not possible to stably eject the liquid droplets. Moreover, an increase in the number of nozzles which eject the liquid droplets lead to a further demand for speedily replenishing the liquid from the common liquid chamber to the individual liquid chamber, so that an inability for the replenishment to catch up with the need thereof causes a droplet ejection failure.

In order to increase an air bubble dischargeability in the liquid ejection head, there is disclosed in a related art document (Patent document 7), for example, that a ceiling section which makes up a liquid flow channel successively includes regions I, II, and III from an ejection port side in accordance with a height from a bottom face section which makes up the liquid flow channel; the regions I and III are parallel to the bottom face section which makes up the liquid flow channel; a liquid flow channel in the region I is higher than the liquid flow channel in the region III; the region II has an inclination increasing in the height of the liquid flow channel from the region III to the region I; the region II is formed within the range of distance L1-L2 from a reference point which is an intersection between the ceiling section and an ejection port forming face; the bottom face section has an ejection pressure generating unit within the range of distance LH1-LH2 from a projection point of the reference point onto the bottom face section; and a relationship between the ceiling section and the bottom face section meets a predetermined relational expression.

Moreover, Patent document 8 discloses a liquid droplet ejection head having a piezoelectric element, wherein near edges of an ink inlet and an ink outlet of a pressure chamber are formed respectively in corresponding projecting sections extending inside along the longitudinal direction of the pressure chamber, thus enhancing an ink flow rate, and making it easier to discharge an air bubble.

Furthermore, Patent document 9 discloses filling a curing material in a step section formed in a flow channel, and smoothing a flow channel inner wall, thus preventing an air bubble from remaining and a pressure wave from attenuating in the step section.

Patent Documents

Patent document 1: JP7-156387
Patent Document 2: JP2002-113529
Patent Document 3: JP2007-144706
Patent Document 4: JP2004-153478
Patent Document 5: JP2000-263799
Patent Document 6: JP2007-152663
Patent document 7: JP3495863
Patent Document 8: JP2006-205621
Patent Document 9: JP2008-74034

DISCLOSURE OF THE INVENTION

There is a problem that, with respect to the above-described flow channel plate and the method of manufacturing thereof, according to the above-described technique disclosed in Patent document 4, a pitch of through holes to be pressure generating chambers becomes coarse at four or five times that of a printing resolution, so that a head becomes large and an image forming device also becomes large.

Moreover, the technique disclosed in Patent document 5 uses a so-called forging method in which a thin metal sheet is inserted between a first die and a second die to be shaped, wherein the first die is provided with multiple projecting sections corresponding to recess sections to be pressure generating chambers and ink supply ports, and the second die is provided with multiple projecting sections corresponding to walls lying between the pressure generating chambers.

In this case, it is necessary to form a number of projecting sections and recess sections, which number corresponds to the number of nozzles needed for the first and second dies. In other words, all the projecting sections and the recess sections are required to have the pitch and the shape of the pressure generating chambers that are necessary to stabilize the amount of ejection of the ink droplet. Moreover, there is a problem that, as the wall sections which partition the pressure generating chamber are arranged to be formed by causing an area between the projecting sections formed on the first die to protrude, which requires large power as pressing force for press working, the wall sections need to be structured as dies which can withstand the large power, which leads to an increased cost of the dies and an increased cost of the head.

Furthermore, in order to achieve an increased speed for an image forming device which uses an inkjet recording head, a line-type recording head module is used which arranges multiple heads in a staggered fashion. In order to reduce the number of heads as much as possible for arranging such a head module as described above, denser nozzles and a long head are needed.

However, with the method of press working disclosed in Patent document 4, making the head long means that it is necessary to make the size of the first and second dies the size of a die corresponding to the length of the head, leading to a significant increase in the cost of the die. Moreover, the flow channel plate formed by the press working needs to undergo a process of polishing a joining face before it is joined with the nozzle plate and the vibrating plate member, which leads to an increased cost of parts.

In light of the above, there is a method of forming, by press working, a through hole to be a pressure generating chamber, as disclosed in Patent document 6. While the previously-mentioned document does not disclose any specific processing method, a location hole is to be formed on a blank plate by press working and then the through hole to be a pressure generating section and a fluid resistance section is to be opened with the hole as a reference.

In the technique disclosed in Patent technique 6, dies are arranged to include a first die having at least a punch with a shape for opening a through hole and a second die having a hole corresponding to the punch. A tip which is pushed out by a projecting punch of the first die is pushed into the hole section of the second die. The depth of the hole section provided in the second die is arranged such that the hole section becomes wider beyond approximately the same length as that of the punch of the first die, or a length which is slightly shorter therethan. In this way, a chip pushed into the hole is to be discarded through the hole of the second die.

However, the wall which partitions the pressure generating chamber formed by such a processing method as described above is to take a boat shape. When the wall in the boat shape is adhesively joined to the nozzle plate and the vibrating plate member, twisting may occur in the boat shape section. More specifically, a thin plate of several μms, such as the vibrating plate member, may be affected by the boat shape when joining, so that a uniform joining is not possible. As a result, a problem occurs such that pressure generating units are bonded in a non-uniform manner, so that a droplet ejection characteristic varies among individual nozzles.

Next, with respect to a flow channel shape of a flow channel plate, an acute angle portion formed by a joining section of the nozzle plate and a flow channel that is disclosed in Patent document 7, and a recess section formed by a liquid chamber wall face and a projecting section path that is disclosed in Patent document 8 structurally cause a narrow section to be formed in a portion of the flow channel, which all the more could cause air bubbles to remain therein. Moreover, as disclosed in Patent document 9, there is a problem that a curing material needs to be filled in after assembling the flow channel section, which may cause a manufacturing variation and an increased cost due to process complexities.

Furthermore, for a liquid ejection type image forming device, high-speed printing, high resolution imaging, and continuous large-sized printing as well as small-sized devices, reduced cost, low running cost, and high reliability in printing are required. Measures for responding to at least one of the requirements described above include an increased nozzle density (600-1200 dpi, for example) of the head itself, and a higher driving frequency. However, a measure other than that for the dischargeability of the air bubbles has not been considered up to now.

More specifically, it is difficult to maintain the capacity of the liquid chamber itself with a high density head of 300 dpi and above, and an exclusion volume (volume for being able to exclude liquid from within a liquid chamber due to displacement of a vibrating plate and expansion of an air bubble). Therefore, even an air bubble which is adhered within the liquid chamber and does not move, and which does not affect meniscus formation could act on a change of the exclusion volume and cause a variation on ejection performance. Moreover, for the high density head of 300 dpi and above, as there is a problem that the printing speed itself cannot be increased in proportion to the high density because of the small exclusion volume, it is necessary to suppress energy loss within the liquid chamber and provide for a more highly efficient ejection performance.

The present invention aims to provide a head of a greater length at a reduced cost so as to overcome the problem as described above.

According to an embodiment of the present invention, a liquid ejection head is provided, including a flow channel plate, the flow channel plate being formed of a thin plate, the flow channel plate being formed with one or more pressure generating chambers, a fluid resistance section which supplies liquid to the pressure generating chamber, and a nozzle hole which opposes the pressure generating chamber, wherein the flow channel plate is made of a metal material, and wherein the flow plate includes:

the pressure generating chamber which is formed of a groove-shaped indentation;

the nozzle hole which is formed at one end in a longitudinal direction of the groove-shaped indentation; and the fluid resistance section which is formed at the other end in the longitudinal direction of the groove-shaped indentation, and wherein the pressure generating chamber, the nozzle head, and the fluid resistance section are formed such that they deform the thin plate in a thickness direction.

According to another embodiment of the present invention, there is a method of manufacturing a liquid ejection head, the liquid ejection head comprising a flow channel plate, the flow channel plate being formed from one thin plate, the flow channel plate being formed with one or more pressure generating chambers, a fluid resistance section which supplies liquid to the pressure generating chamber, and a nozzle hole which opposes the pressure generating chamber, the method comprising the steps of:

pressing the thin plate to deform the pressed thin plate in a thickness direction;

forming the pressure generating chamber, the fluid resistance section, and a nozzle opening section that are formed of a groove-shaped indentation, inside of which nozzle opening section is formed a recess section to be the nozzle hole; and then polishing a tip portion of the nozzle opening section to open the nozzle hole.

According to a further embodiment of the present invention, a liquid ejection head is provided, including:

a fluid channel member which forms one or more nozzles which eject a liquid droplet, a liquid chamber to which the nozzle communicates and a supplying channel which supplies liquid to the liquid chamber; and an actuator unit which pressurizes the liquid within the liquid chamber, wherein, of wall faces of the supplying channel from an inlet portion of the supplying channel to the nozzle, a wall face other than a wall face on a side at which the actuator unit is arranged is an inclined face which always has an inclination relative to a nozzle face and changes continuously.

The embodiments of the present invention make it possible to provide with a head of a greater length at a reduced cost.

BRIEF DESCRIPTION OF THE DRAWINGS

Other objects, features, and advantages of the present invention will become more apparent from the following detailed descriptions when read in conjunction with the accompanying drawings, in which.

BEST MODE FOR CARRYING OUT THE INVENTION

A description is given below with regard to preferred embodiments of the present invention.

The present invention is not limited to the specifically disclosed embodiments, so that variations and modifications may be made without departing from the scope of the present invention.

Figure 1:
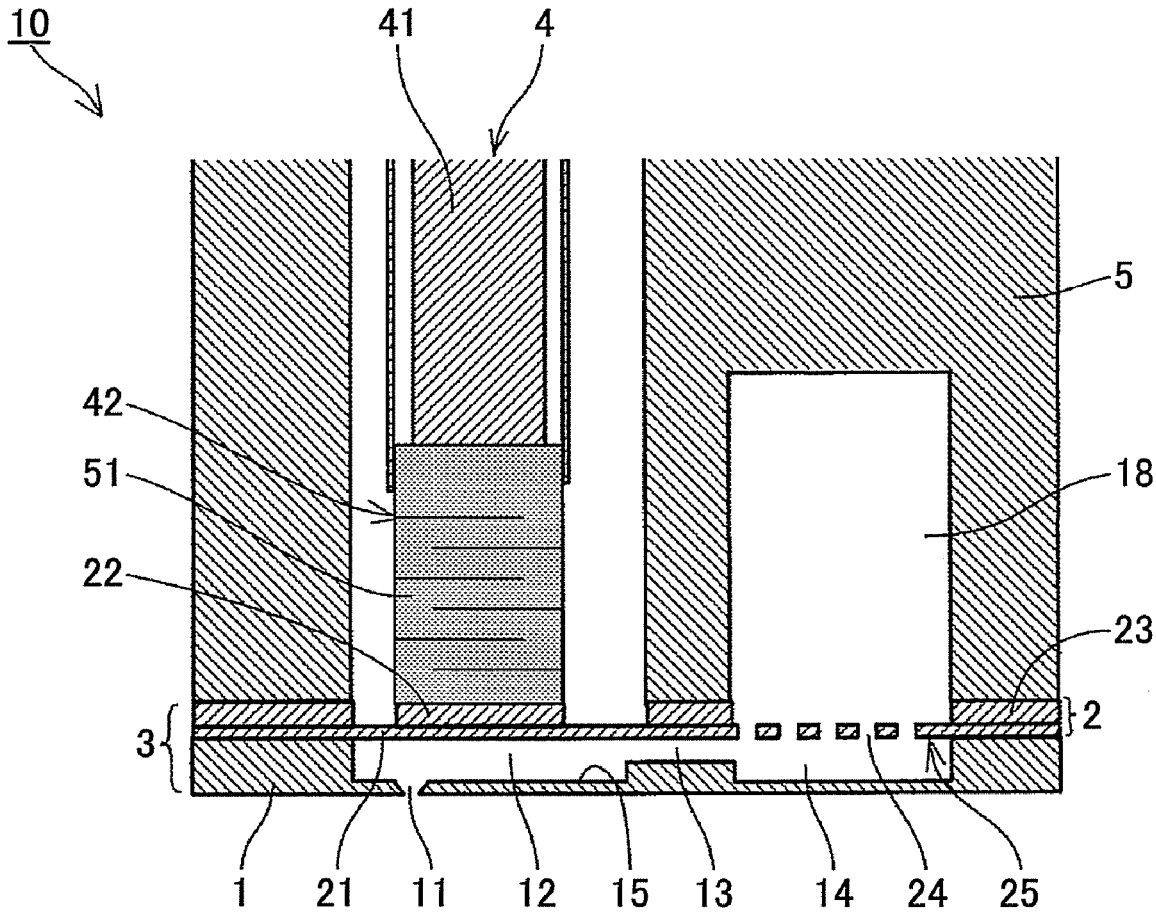
FIG. 1 is a cross-sectional explanatory diagram along a direction orthogonal to a nozzle arrangement direction that serves to explain a first embodiment of a liquid ejection head according to the present invention.
Figure 2:
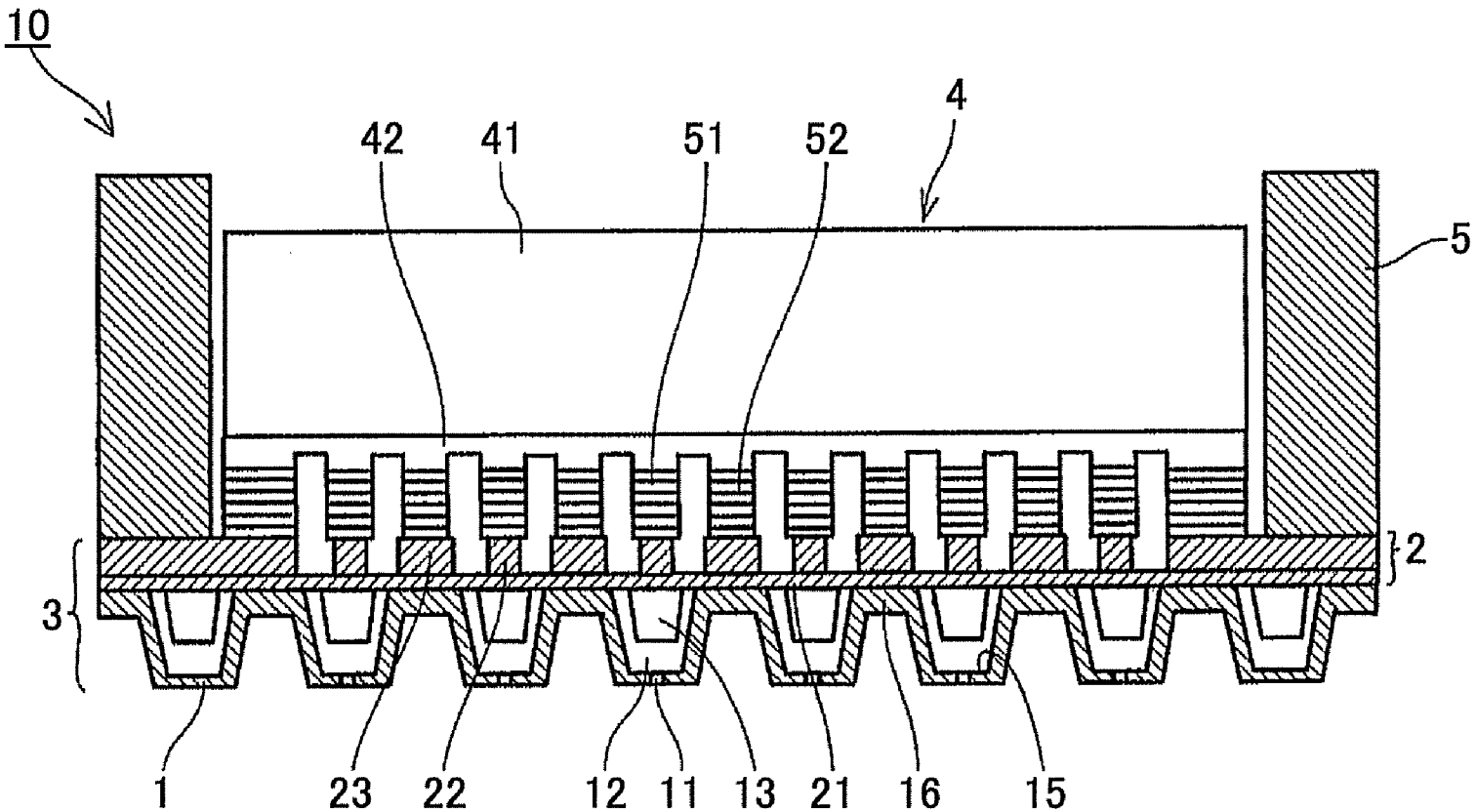
FIG. 2 is a cross-sectional explanatory diagram along the nozzle arrangement direction for the same.

First, a first embodiment of a liquid ejection head according to the present invention is explained with reference to FIGS. 1 and 2. FIG. 1 is a cross-sectional explanatory diagram along a direction orthogonal to a nozzle arrangement direction of the same head, while FIG. 2 is a cross-sectional explanatory diagram along the nozzle arrangement direction of the same head.

The liquid ejection head (a liquid ejection head 10) includes a flow channel unit 3 which is formed by joining a flow channel plate (a chamber plate) 1 and a vibrating plate member (a diaphragm plate) 2; a piezoelectric actuator unit 4 as an actuator unit; a frame member 5, etc.

The flow channel plate 1, which is formed of a thin plate made of a sheet of metal material, is provided with multiple nozzle holes 11 which eject liquid droplets; pressure generating chambers 12 to which corresponding nozzle holes 11 communicate; fluid resistance sections 13 which supply ink to the corresponding pressure generating chambers 12; and an ink introducing section 14 for each of the fluid resistance sections 13. Here, the pressure generating chamber 12 of the fluid channel plate 1 is formed of a groove-shaped indentation 15 formed from the thin plate, the nozzle hole 11 is formed on one end side in the longitudinal direction of the groove-shaped indentation 15, the fluid resistance section 13 is formed on the other end in the longitudinal direction of the groove-shaped indentation 15, the ink introducing section 14 is formed on the other end side beyond the fluid resistance section 13; and the above-described pressure generating chamber 12, the nozzle hole 11, the fluid resistance section 13, and the ink introducing section 14 are formed such that the thin plate is deformed in the thickness direction.

The fluid channel plate 1 is formed by forging press working, for example. In this case, a cross section of the flow channel plate 1 becomes a continuous recess-projection shape as shown in FIG. 2. The recess section, which is the groove-shaped indentation 15, becomes the pressure generating chamber 12 and the fluid resistance section 13 and the ink introducing section 14, while the projecting section becomes the corresponding wall 16. Then, a cross-sectional shape of the pressure generating chamber 12 and the fluid resistance section 13 and the ink introducing section 14 that are to be an ink flow channel is trapezoidally shaped rather than quadrilaterally shaped. (This is also a feature for using forging.)

The width of the fluid resistance section 13 is arranged to be less than the width of the pressure generating chamber 12. Then, the depth thereof is arranged to be less than the depth of the pressure generating chamber 12. While the depth and the width of the fluid resistance section 13 may be arranged to be the same as those of the pressure generating chamber 12, they may be arranged to be smaller than those of the pressure generating chamber 12, so that the fluid resistance section 13 serves as a resistance section in which ink within the pressure generating chamber 12 is to return to the ink introducing section 14 side at the time of ejecting the liquid droplet, making it possible to more efficiently eject the droplet.

Moreover, the location of the nozzle hole 11 is preferably closer to the end of the pressure generating chamber 12. In this way, it becomes easier to exclude an air bubble when the ink is filled into the pressure generating chamber 12, making it possible to bring about improvement in the reliability of ejection and reduction in ink disposal amount for discharging the air bubble. Moreover, it becomes easier for the air bubble to be discharged when it finds its way into the pressure generating chamber 12. Furthermore, the groove-shaped indentation 15 extends from the fluid resistance section 13 to immediately below a common liquid chamber 18 as the ink introducing section 14. In this way, in a manner similar to what was described previously, the ink is smoothly introduced from the fluid resistance section 13 to the pressure generating chamber 12.

The vibrating plate member 2 forms a part of the wall face of the pressure generating chamber 12, the fluid resistance section 13, and the ink introducing section 14. A portion forming the wall face of the pressure generating chamber 12 of the vibrating plate member 2 is arranged as a deformable area (a vibrating plate area: a diaphragm) 21. On a face opposite the pressure generating chamber 12 of the vibrating plate member 21 is formed a projecting section 22 which joins the piezoelectric actuator 4. Moreover, a thick wall section 23 is formed on an area which joins a below-described non-driving piezoelectric element column 52 opposing an area in between the pressure generating chambers 12, on an area which joins the frame member 5, etc. Furthermore, on a portion which forms a wall face of the ink introducing section of the vibrating plate member 2 is provided a filter section 25, on which are formed multiple through holes 24 which allow communication between the ink introducing section 14 and the common liquid chamber 18, which is a common liquid reservoir formed on the below-described frame member 5.

This vibrating plate member 2 may be formed by a Ni electroforming, for example. The thickness of the vibrating plate area 21 may be arranged as 3-7 μm, for example, while the thickness of the projecting section 22 and the thick-wall section 23 may be arranged as 10-20 μm, for example. Instead of the Ni electroforming, it may be formed using a stainless steel thin plate with a thickness of 5-10 μm.

The piezoelectric actuator 4 has a base member 41 on which are joined one or multiple piezoelectric element members 42, on which piezoelectric element member is formed a non-driving (dummy) piezoelectric column 52 and a driving piezoelectric column 51 which are divided into multiple comb-tooth shapes by a slit groove process such as half-cut dicing, etc. The driving piezoelectric element column 51 is joined to the projecting section 22 of the vibrating plate area 21 of the vibrating plate member 2, while the non-driving piezoelectric element column 52 is joined to the thick wall section 23 opposing the area in between the pressure generating chambers 12 of the vibrating plate member 2. The piezoelectric element member 42 has a laminating type piezoelectric element member arranged by laminating a conductive material and a piezoelectric material; it may be used with a displacement in the d33 direction, an arrangement using a displacement in the d31 direction or an arrangement using a bend-distortion piezoelectric element, which has at least one layer of piezoelectric material arranged on a flat plate on the vibrating plate area 21 of the vibrating plate member 2.

Moreover, while a piezoelectric actuator is used here, it may be arranged for a thermal actuator or an electrostatic actuator to be used.

The frame member 5 holds the flow channel unit 3 and forms the common liquid chamber 18 which introduces and stores ink from an ink tank (not shown), and has a piezoelectric actuator 4 inserted. The frame member 5 is arranged to be a member with rigidity which is several times that of the rigidity of the flow channel unit 3. For example, it is formed by cutting a metal, or by a molding process, in which resin is dissolved. The flow channel unit 3, the frame member 5, and an adhesive which joins them are in direct contact with ink, so that materials therefore are selected which can sufficiently withstand solvents included in the ink such that they are not dissolved therein.

In the liquid ejection head 10 thus arranged, the driving piezoelectric element column 51 is contracted by lowering, from a reference potential, a voltage to be applied to the driving piezoelectric element column 51 of the piezoelectric element member 42, and the vibrating plate area 21 of the vibrating plate member 2 is deformed to expand the volume of the pressure generating chamber 12. Thus, ink flows into the pressure generating chamber 12, and then, the driving piezoelectric element column 51 is expanded in the laminating direction by raising the voltage to be applied to the driving piezoelectric element column 51, and the vibrating plate area 21 is deformed in the nozzle hole 11 direction to contract the volume of the pressure generating chamber 12. Thus, the ink within the pressure generating chamber 12 is pressurized and an ink droplet is ejected from the nozzle hole 11.

Then, the voltage to be applied to the driving piezoelectric element column 51 is brought back to the reference potential, so that the vibrating plate area 21 is restored to the initial location, and the negative pressure is generated due to the pressure generating chamber 12 expanding. Thus, the ink is filled into the pressure generating chamber 12 from the common liquid chamber 18. Thus, after a vibration of a meniscus face of the nozzle hole 11 damps to be stabilized, it shifts to an operation for the next droplet ejection.

The above-described head driving method is not limited to the above examples (pull-push hit), so that pull hit, push hit, etc. may be performed depending on the way the driving waveform is provided.

In this way, in the liquid ejection head 10, a thin plate made of one sheet of metal material is deformed in the thickness direction to integrally form an ink flow channel from the liquid resistance section 13 via the pressure generating chamber 12 to the nozzle hole 11, making it possible to achieve a reduced cost, and a lengthened head. Moreover, a wall face to be in contact with the liquid may be formed as a smoother face relative to a cutout section of the liquid channel hole formed from a fluid resistance section to a pressure generating chamber that is produced with the prior art press working, thus making it possible for the ink to flow smoothly (close to a laminar flow) and making it possible to improve the dischargeability of the air bubbles. Furthermore, it becomes unnecessary to join, with an adhesive, a nozzle plate having a nozzle hole and a flow channel plate having a pressure generating chamber, so that a decrease in air bubble dischargeability due to an obstruction to a flow of ink by the adhesive squeezing out from inbetween the members that is produced by joining, or a decrease in wettability between the adhesive and the ink, is overcome, making it possible to reduce assembly man-hours.

Figure 3A:
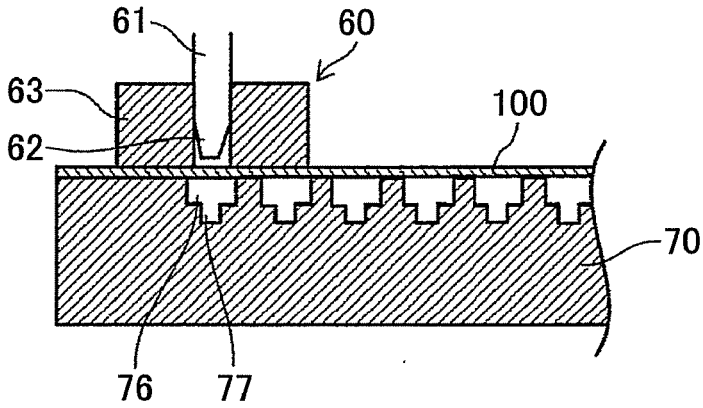
FIGS. 3A through 3D are cross-sectional explanatory diagrams which serve to explain a first embodiment of a method of manufacturing the liquid ejection head according to the present invention.
Figure 3B:
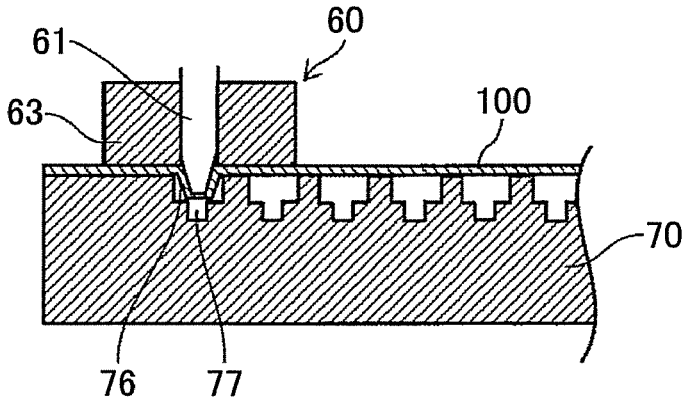

Next, a first embodiment of a method of manufacturing of the liquid ejection head according to the present invention that forms the flow channel plate of the liquid ejection head according to the first embodiment is described with reference to FIGS. 3A through 4. FIGS. 3A through 3D are explanatory diagrams which serve to explain processes of manufacturing a flow channel plate according to the present embodiment.

A device which manufactures the flow channel plate 1 includes a first upper die 60 and a second upper die 65 and a lower die 70. The first upper die 60 has a punch 61 for a pressure generating chamber that has a projecting portion 62 which includes a projecting section 62*a* opposing the pressure generating chamber 12 and a projecting portion 62*b* opposing the fluid resistance section 13 as shown in FIG. 4 that is for simultaneously forming a groove-shaped indentation 15 to be the fluid resistance section 13 and the pressure generating chamber 12, and a stripper 63 to be a guide for the punch 61 to move (or slide) up and down. It suffices that there is at least one punch 61. Moreover, the second upper die 65 which is parallel to the first upper die 60 has a punch 66 for a nozzle that has a shape of a nozzle hole 11, and a stripper 67 to be a guide for the punch 66 to move (or slide) up and down.

The lower die 70 has formed therein a long and narrow groove section 76 which receives the punch 61 of the first upper die 60. On the bottom of the groove section 76 is provided a cylindrically-shaped recess section 77 for the nozzle hole 11. The groove section 76 is structured to be a number of dies, which number corresponds to at least one column of the nozzle holes 11 of the head 10.

Then, as shown in FIG. 3A, a thin plate (below-called "a blank material" 100) which is made of a metal material provided on the lower die 70 is fixed with the stripper 63 of the upper die 60. From this state, as shown in FIG. 3B, the punch 61 slides down (in the gravity direction), and the blank material 100 is pushed by the projecting section 62 of the punch 61 into the groove section 76 provided in the lower die 70. In other words, here, press working is performed which is similar to a so-called deep drawing. The narrow and long groove-shaped indentation 15 is formed with the process described thus far, below called a first process, so that the pressure generating chamber 12 and the fluid resistance section 13 are formed simultaneously.

Here, a steel material such as an SUS material may be used as the blank material 100. For example, from the point of view of workability and versatility of the press working, SUS304H, SUS316L, SUS304-3/4H, etc., are suitable. Moreover, an SUS304H-TA material that is applied thereto a tension-annealing process is difficult to be deformed in the process of heating in joining a vibrating plate member and a flow channel member (a member integral with a nozzle plate liquid chamber) and a vibrating plate member, so that it is particularly preferable.

Figure 3C:
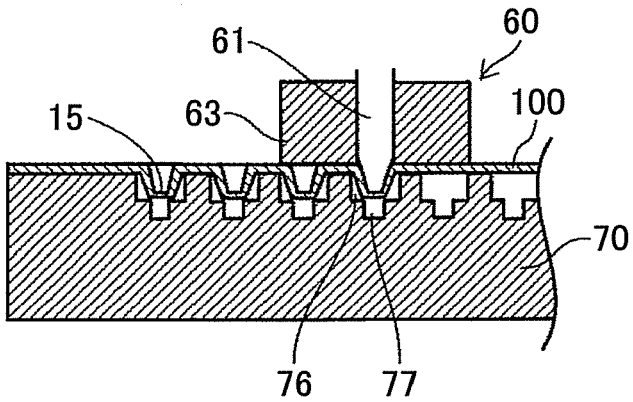
Figure 3D:
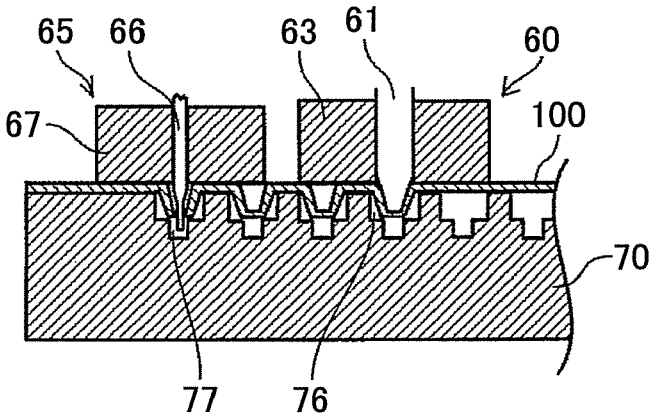
Figure 4:
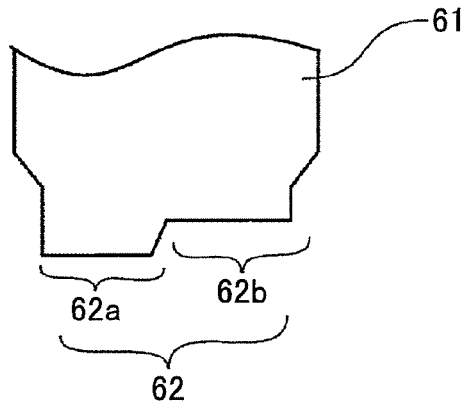
FIG. 4 is an explanatory diagram which serves to explain a tip shape of an upper die punch for the same.

Then, the punch 61 returns to the original position, moves away with the stripper 62 from the blank material 100, and moves to the next press position as shown in FIG. 3C. Such a process as described above is repeated a number of times, so that the groove-shaped indentation 15, which is formed first reaches immediately below the punch 66 for the nozzle hole 11 that is on the second upper die 65. Here, as shown in FIG. 3D, the punch 66 for the nozzle of the second upper die 65 is pushed into the groove-shaped indentation 15 formed in the above-described first process up to the cylindrically-shaped recess section 77 of the lower die 70. With this second process, a nozzle opening section 102 (see FIG. 5) is formed, inside which is formed a recess section 101 to be a nozzle opening hole 11 on one end side of the groove-shaped indentation 15. Here, the nozzle opening section, which means a portion where the nozzle hole 11 is to be opened, is yet to be opened.

Thereafter, the above-described processes shown in FIGS. 3A -3D are repeated, so that the nozzle opening section 102 and the groove-shaped indentation 15 to be the fluid resistance section 13 and the pressure generating chamber 12 that are needed for the head 10 are formed. The blank material 100 at this stage is not penetrated as the nozzle hole 11.

Figure 5:
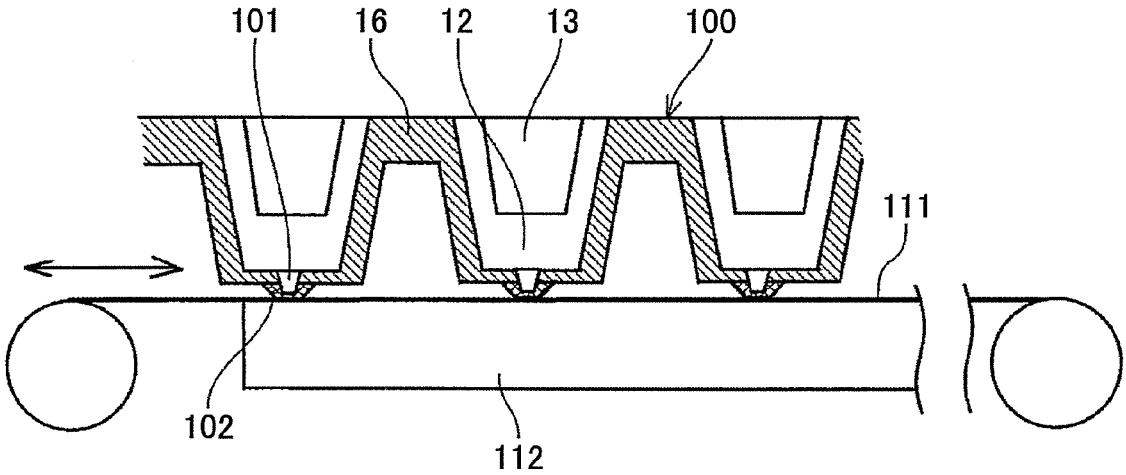
FIG. 5 is an explanatory diagram which serves to explain a process of opening a nozzle hole for the same.

Then, as shown in FIG. 5, a tip portion (a portion illustrated within a different hatching in FIG. 5) of the nozzle opening section 102 which has a recess section 101 to be the nozzle hole 11 formed by press working is polished and removed to open the nozzle hole 11. The polishing process (nozzle hole opening process) is to be called a third process herein. In this polishing process, the blank material 100 is fixed with a fixture (not shown) and, while lightly pushing a polishing/lapp film 111 against the tip portion of the nozzle opening section 102 with a pushing member 112 and while moving the polishing/lapp film 111 both ways in the direction shown with an arrow (alignment direction of the nozzle holes 11), the tip of the nozzle opening section 102 is polished, so that the nozzle hole 11 is opened.

Through the above-described first through third processes, the flow channel plate 1 is obtained which has the fluid resistance section 13 and the pressure generating chamber 12 on which a nozzle hole 11 is opened. The blank material 100 (flow channel plate 1) formed by the above-described press working becomes wave-shaped as shown in FIG. 5.

Moreover, although not shown, a face of the flow channel plate 1 that joins the vibrating plate member 2 is polished so as to ensure flatness. This makes it possible to conduct a uniform joining process when the piezoelectric actuator 4 is joined, making it possible to reduce variations among the nozzle holes 11 in droplet speed and droplet volume.

Then, the flow channel plate 1 and the vibrating plate member 2 are joined and the piezoelectric actuator 4 and the frame member 5 are joined to obtain the above-described liquid ejection head 10.

It is preferable that a gap between the punch 61 of the upper die and the groove section 76 of the lower die 70 be at least greater than the plate thickness of the blank material 100. This is because it suffices to make only the accuracy of the forward feeding of the upper die 60 high, so that the location of the groove section 76 of the lower die 70 may be set at a relatively rough accuracy, making it possible to reduce the die cost. In such a die configuration, the blank material 100 and the lower die 70 are arranged to be fixed with only the first upper die 60 and the second upper die 65 being movable. A method of fixing the blank material 100 to the lower die 70 is not particularly limited, so that the blank material 100 may be located by such a manner as using a pin provided at the lower die 70.

Moreover, with the projecting sections and the recess sections being formed on the nozzle face, when wiping is carried out which is done at the timing of cleaning the nozzle face, ink adhered to a wiper member is scraped off by the projecting section to be retained on the recess section, making it possible to make contact therewith using the wiper member when a next nozzle is wiped, making it easier to remove the ink near the nozzle. Furthermore, this leads to an advantage that contaminants are prevented from being adhered to the nozzle section. In this case, although not shown, the ink retained in the recess section formed on the nozzle face can be removed by providing an ink absorbing mechanism at a groove rear end (e.g., at a location on the side of the common liquid chamber 18 as shown in FIG. 1) such that the ink absorbing mechanism is in contact with the projecting section.

Next, a second embodiment of the method of manufacturing the liquid ejection head according to the present invention that forms the flow channel plate of the liquid ejection head according to the first embodiment is described with reference to FIGS. 6A through 6D. FIGS. 6A through 6D are explanatory diagrams which serve to explain the process of manufacturing the flow channel plate according to the same embodiment.

Figure 6A:
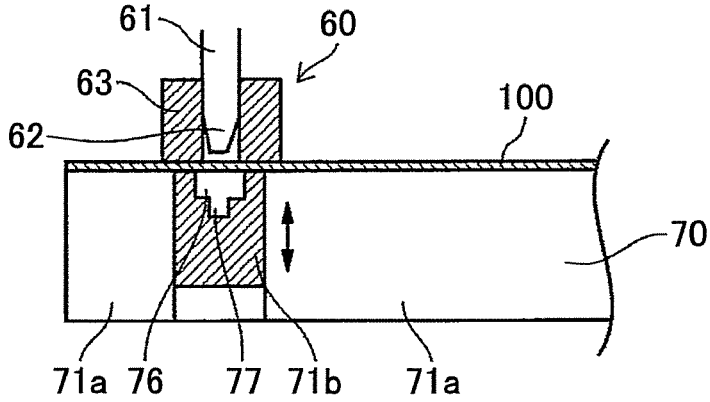
FIGS. 6A through 6D are cross-sectional explanatory diagrams which serve to explain a second embodiment of the method of manufacturing the liquid ejection head according to the present invention.
Figure 6B:
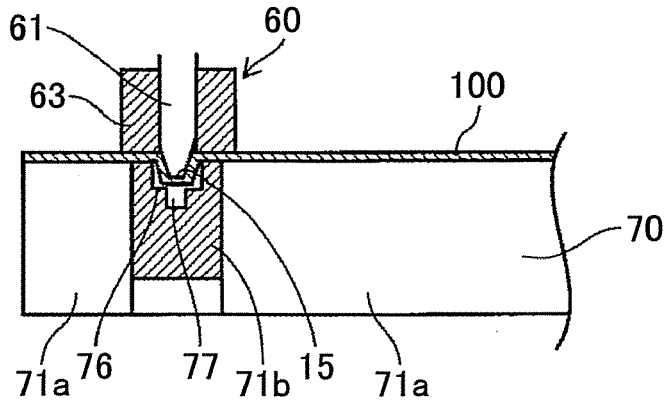

Here, the lower die 70 is arranged to have a die configuration separating a die 71*a* and a die 71*b* such that the die 71*b* in which a groove section 76 and a recess section 77 are formed moves up and down (in directions indicated with arrows) in FIG. 6A relative to the die 71*a*. In this way, the upper die 60 and the lower die 70 may be arranged to be a completely paired die structure. Here, the die 71*b* of the lower die 70 is preferably arranged such that it dents the die 71*b* side in order to avoid interference with a portion to be a pressure generating chamber 12 that is pushed out by the first upper die 60.

Figure 6C:
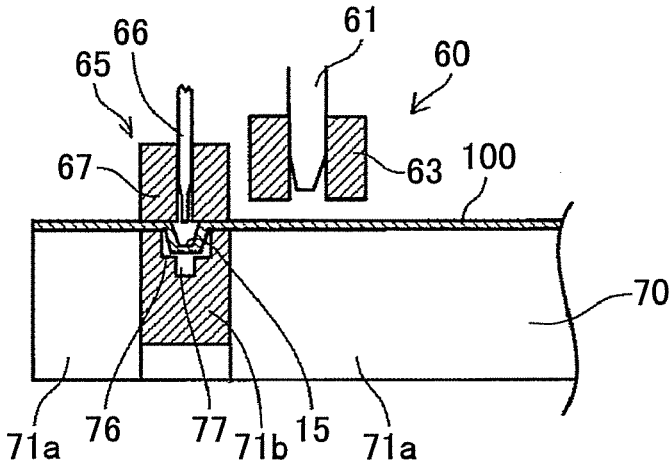
Figure 6D:
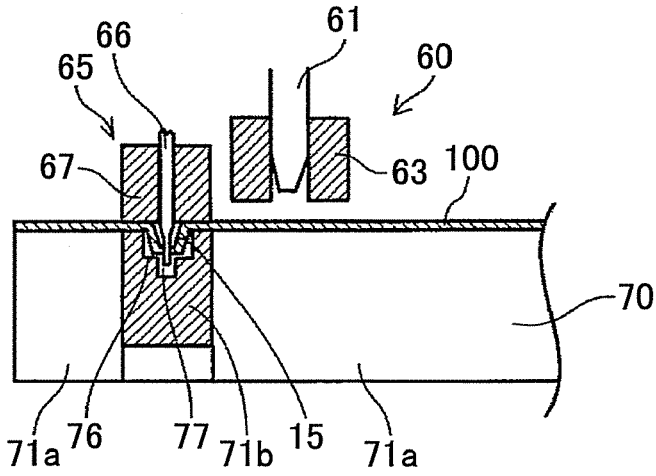

In this embodiment, the manufacturing process of the flow channel plate 1 is performed using the first process or the third process as in the previously described embodiment. In other words, first, as shown in the states from FIG. 6A to FIG. 6B, a narrow and long groove-shaped indentation 15 to be the pressure generating chamber 12 and the fluid resistance section 13 is formed with the first upper die 60. Next, as shown in FIG. 6C, the first upper die 60 slides up and the second upper die 65 moves to a location opposing the die 71*b* of the lower die 70. Then, in the second process, as shown in FIG. 6D, the punch 66 for the nozzle moves down, so that it is pushed into the recess section 77 provided on the groove section 76 of the die 71*b* of the lower die 70. In this way, a nozzle opening section 102 is formed on which a recess section to be the nozzle hole 11 is formed. Such a process can continuously be repeated to manufacture a blank material 100 before the nozzle hole 11 penetrates therethrough.

Thereafter, as in the first embodiment, the nozzle hole of the nozzle opening section 102 is opened in the polishing process.

A die configuration such as the above-described embodiment makes it possible to reduce the size of the overall die.

Next, a third embodiment of the method of manufacturing the liquid ejection head according to the present invention that forms the flow channel plate of the liquid ejection head according to the first embodiment is described.

In the above-described first and second embodiments, the groove-shaped indentation 15 to be the pressure generating chamber 12 is formed earlier than the nozzle opening section 102 for the nozzle hole 11. In this case, the amount of strokes for pushing in the punch 66 of the nozzle hole becomes larger.

Then, in the third embodiment, the process of punching the nozzle hole that is a second process of the first and second embodiments (the process as shown in FIG. 3C and FIG. 6C, for example) is called a first process in which the nozzle opening section 102 which corresponds to a nozzle hole 11 necessary is formed first. Next, as the second process, as described in FIG. 5, a tip portion of the nozzle opening section 102 formed with the punch 66 is polished to open the nozzle hole 11. With the polishing process, the blank material 100 becomes a flat plate again. Then, as the last and the third process, the groove-shaped indentation 15 to be the pressure generating chamber 12 and the fluid resistance section 13, etc., is formed (e.g., processes in FIG. 3D and FIG. 6D). In this case, in respective first and second processes, upper die and lower die are provided as a pair on a dedicated basis.

Figure 7:
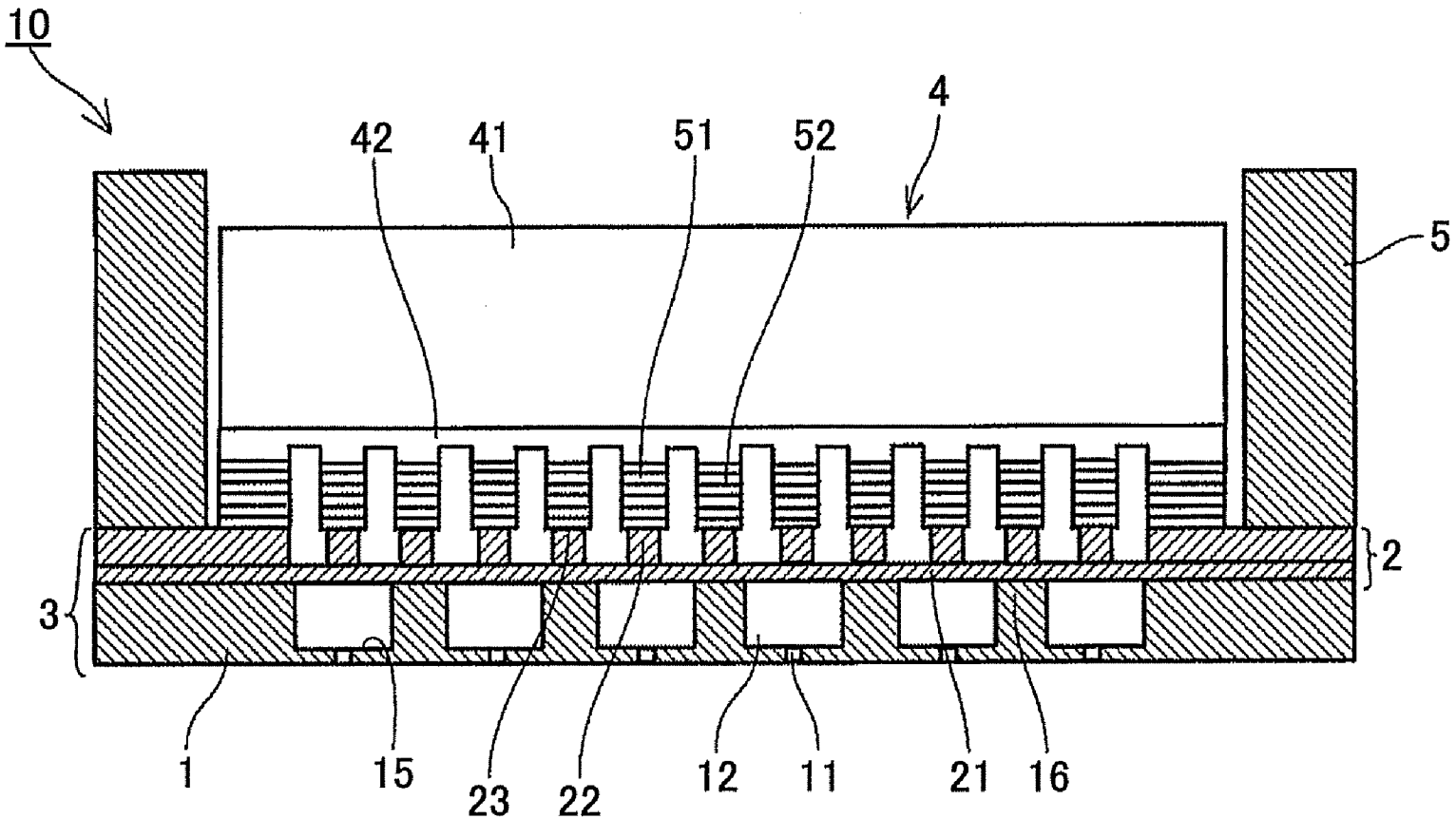
FIG. 7 is a cross-sectional explanatory diagram along the nozzle arrangement direction that serves to explain a second embodiment of the liquid ejection head according to the present invention.

Next, a second embodiment of liquid ejection head according to the present invention is described with reference to FIG. 7. FIG. 7 is a cross-sectional explanatory diagram along a nozzle arrangement direction of the same head.

The flow channel plate 1 of the liquid ejection head is formed by a half pierce work process which is one of the press working processes. In other words, after the pressure generating chamber 12 is formed, the nozzle hole 11 is formed by forging. In this case, the cross section of the pressure generating chamber 12 is substantially quadrilaterally shaped, and the face of the nozzle hole 11 may be made substantially flat. The previously-described arrangement also makes it possible to achieve the same operational advantage as the first embodiment.

Next, a fourth embodiment of the method of manufacturing the liquid ejection head according to the present invention that forms the flow channel plate of the liquid ejection head according to the second embodiment is described with reference to FIGS. 8A through 10.

First, a manufacturing device has a first upper die 80 and a lower die 90. The first upper die 80 has a punch 81 for a pressure generating chamber that has a projecting section 82 for simultaneously forming the groove-shaped indentation 15 to be the pressure generating chamber 12 and the fluid resistance section 13. It suffices that there is at least one punch 81. The lower die 90 is arranged to be a die structure having the a number of recess sections 96 for receiving the punch 81, the number being the same as the number of nozzle holes 11 of the head. The recess section 96 is shaped as a narrow and long groove.

Figure 8A:
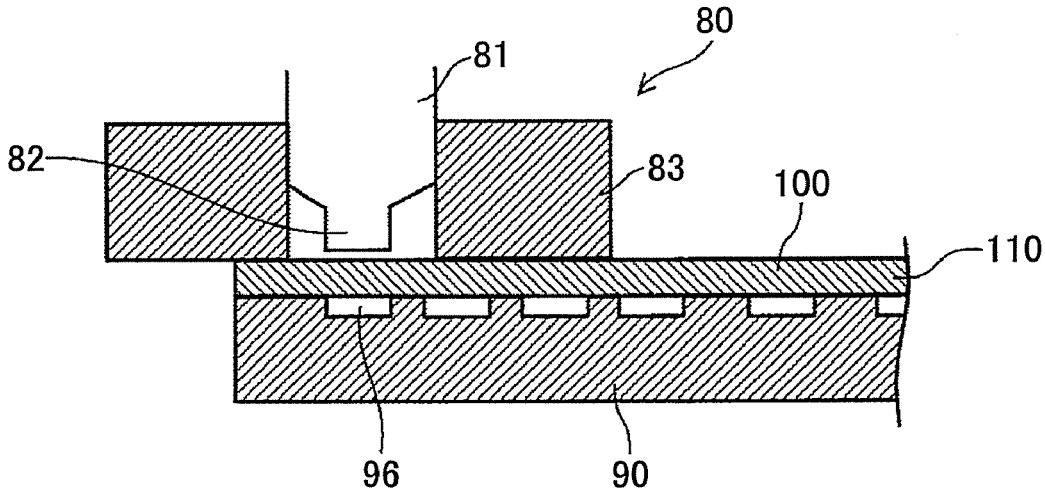
FIGS. 8A through 8C are cross-sectional explanatory diagrams which serve to explain a fourth embodiment of the method of manufacturing the liquid ejection head according to the present invention.
Figure 8B:
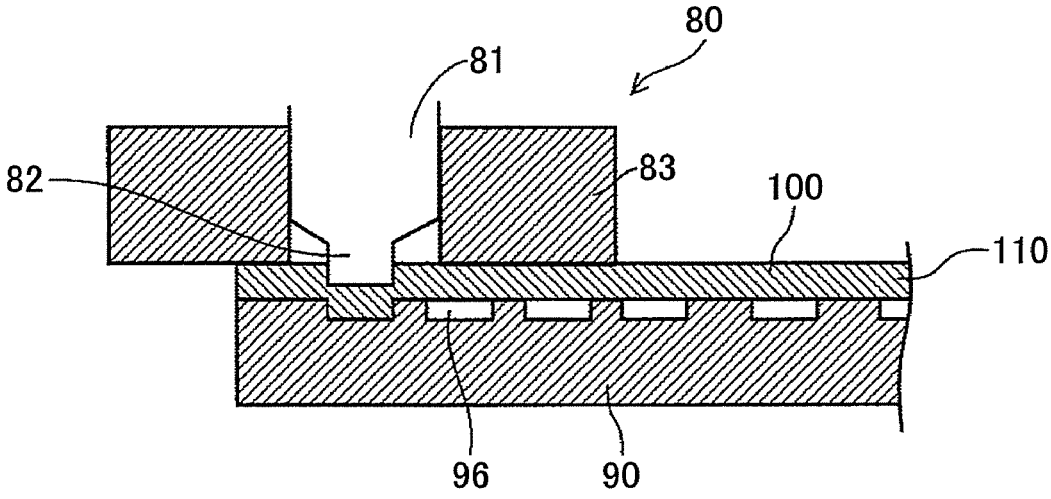

Then, as shown in FIG. 8A, the blank material 110 provided on the lower die 90 is fixed with the stripper 83 of the upper die 80. From this state, the punch 81 slides down, so that, as shown in FIG. 8B, the blank material 100 is pushed into the recess section 96 provided in the lower die 90. Then, the pushing in of the punch 81 is stopped at a location such that the amount being pushed in becomes less than the plate thickness of the blank material 100. Moreover, unlike the first embodiment, the gap between the punch 81 and the recess section 96 is not more than the plate thickness, and is a gap of approximately 3 μms, for example. With the process thus far (below called the first process), The narrow and long groove-shaped indentation 15 to be the pressure generating chamber 12 and the fluid resistance section 13 is formed.

Figure 8C:
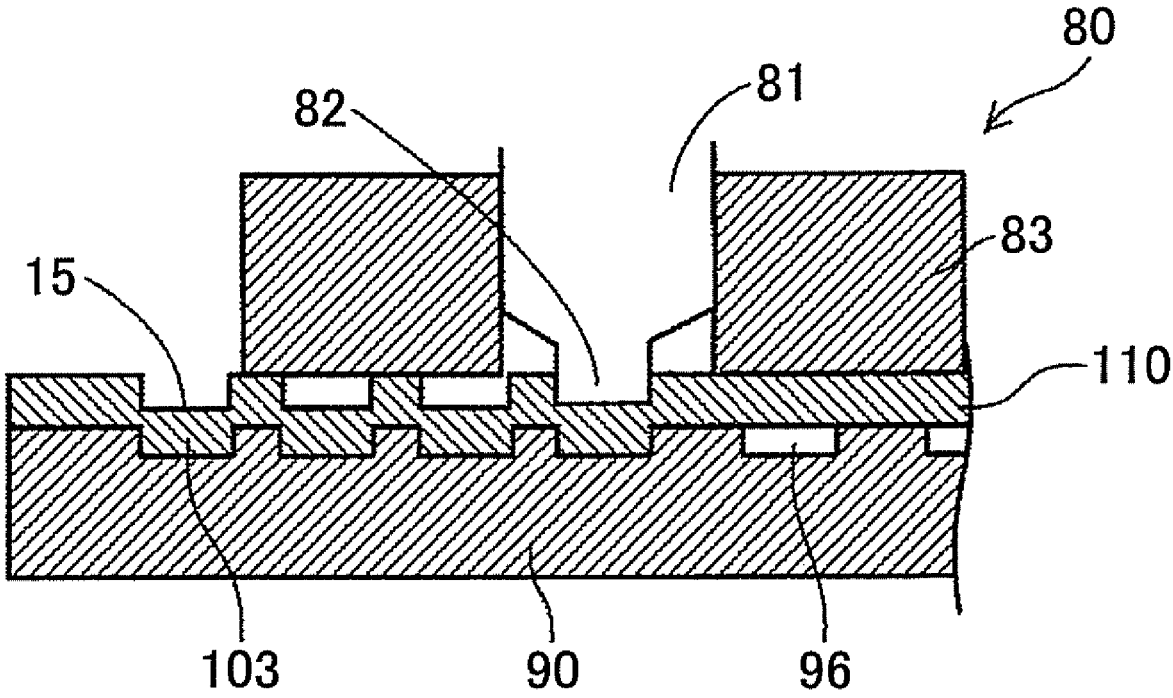

Thereafter, the punch 81 is returned, moves away from the blank material 110 with the stripper 82, and, as shown in FIG. 8C, moves to the next press location, so that once again the punch 81 is pushed in. The press working process in FIGS. 8A through 8C are repeated to form the groove-shaped indentation 15 which forms the pressure generating chamber 12 and the fluid resistance section 13 that are needed for the head, etc. The blank material 110 in this state is a state such that the projecting section 103 to be a face of the nozzle hole 11 and a recess section (the groove-shaped indentation 15) on the pressure generating chamber 12 side are formed, but the nozzle hole 11 is not formed.

Figure 9A:
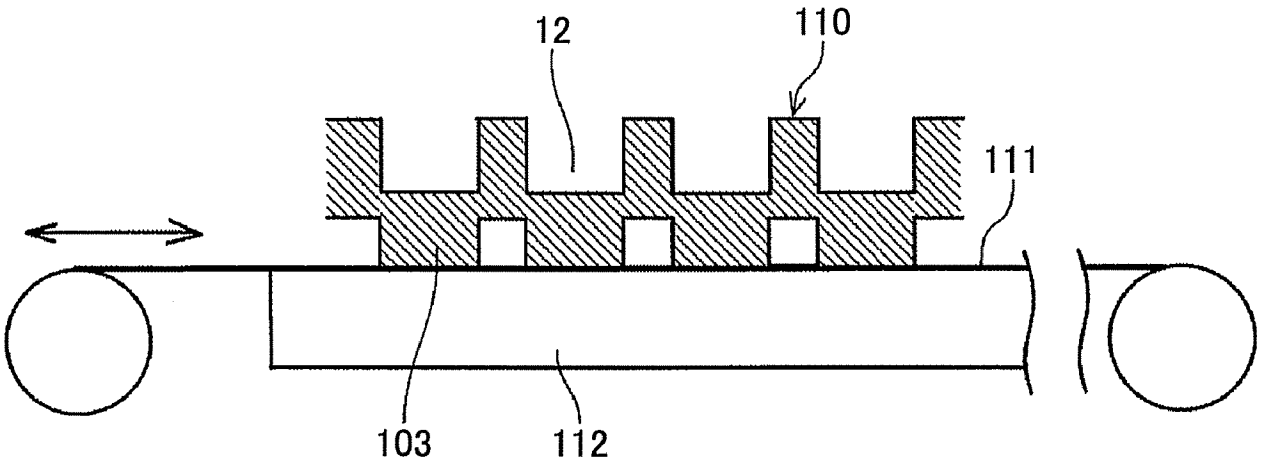
FIGS. 9A and 9B are explanatory diagrams which serve to explain a process of polishing for the same.

Next, only a projecting portion (a portion which projects from the surface of the blank material 110) out of the projecting section 103 and the recess section formed by the press working (the grooved-shaped indentation 15) is polished. The polishing method is the same as the method shown in FIG. 5, the overview of which is shown in FIG. 9A. In other words, the lapp film 111 is arranged to be in contact with the projecting section 103 face of the blank material 100 processed by the previously-described press working. Then, the lapp film 111 is lightly pushed against the pushing member 112, and is moved back and forth in the column direction (direction indicated with the arrow) of the nozzle hole 11. This makes it possible to finish the face of the nozzle hole 11 to be processed in the next process substantially flat. The previously-described process is to be called the second process.

Figure 9B:
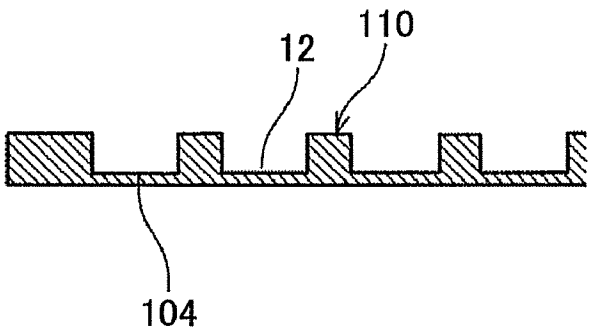

With the above-described process, a thin wall section 104 which opposes the pressure generating chamber 12 shown in FIG. 9B is formed and the blank material 110 which is made integral with the member corresponding to the nozzle plate is obtained.

Figure 10:
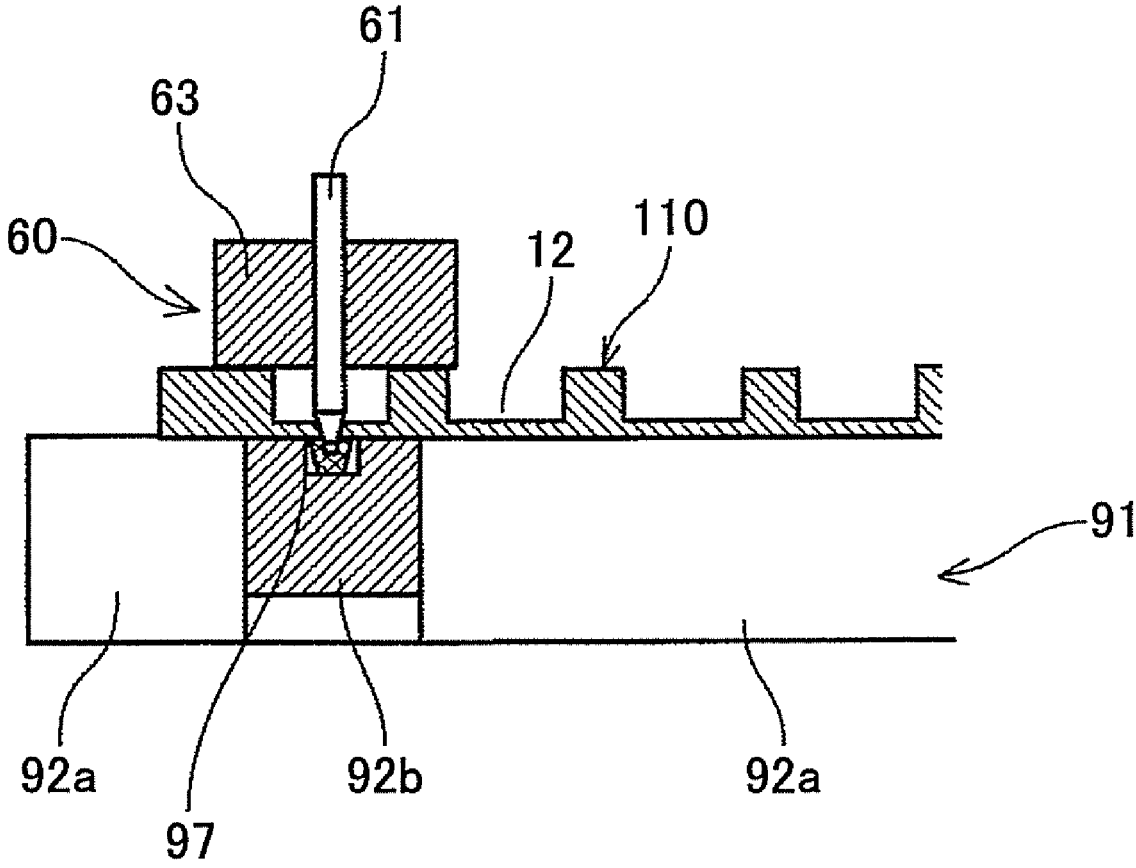
FIG. 10 is an explanatory diagram which serves to explain a process of forming an opening for the nozzle hole for the same.

Next, a projecting section to be the nozzle hole 11 is formed on the thin wall section 104 by a press technique using forging. As shown in FIG. 10, a lower die 91 which includes a die 92*b* having a groove 97 and a die 92*a*, and a punch 61 for processing the nozzle hole may be used to perform processing in a manner similar to the previously-described method in FIGS. 6C and 6D. The previously-described process is called a third process. Thereafter, with the fourth process which polishes the projecting section with the method shown in FIG. 5, the flow channel plate 1 is obtained on which the nozzle hole 11 and the pressure generating chamber 12 are integrally formed.

Figure 11:
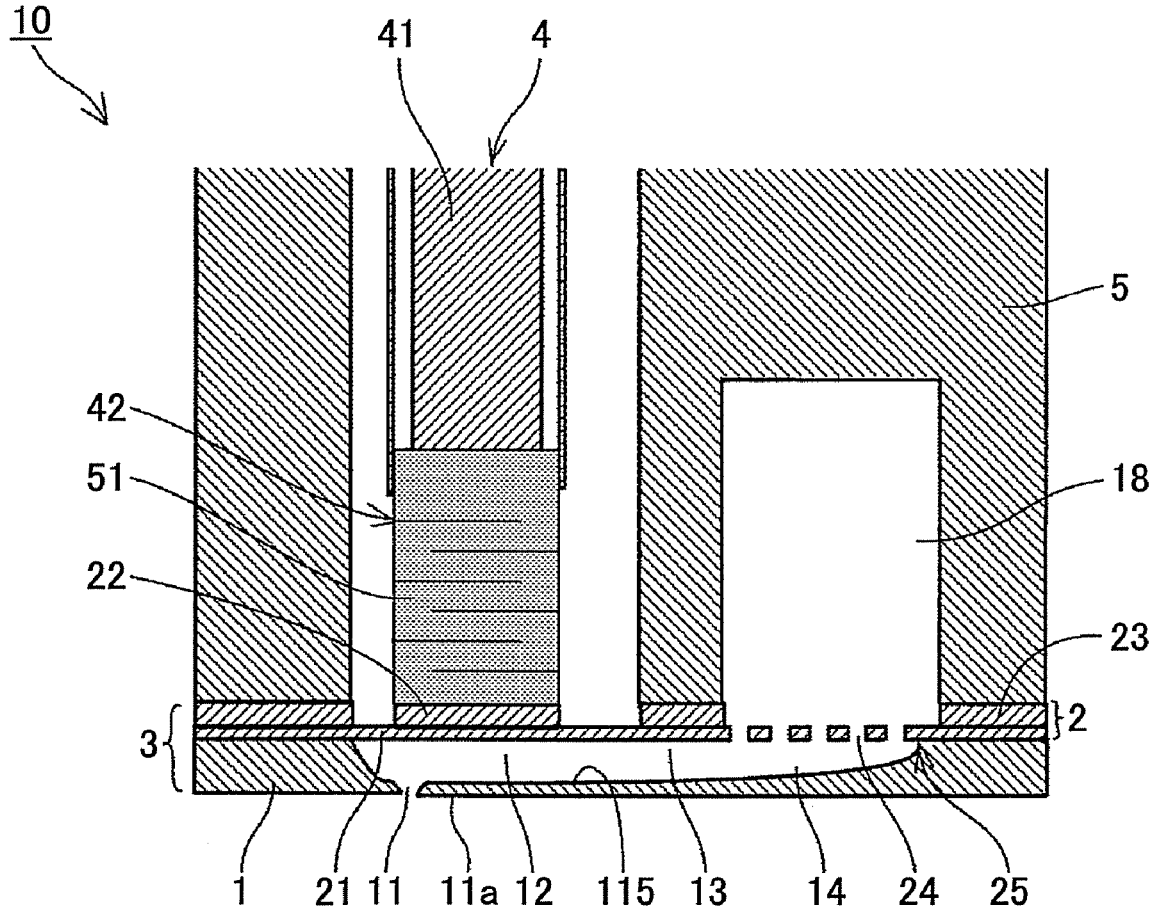
FIG. 11 is a cross-sectional explanatory diagram along the direction orthogonal to the direction of the nozzle arrangement that serves to explain a third embodiment of the liquid ejection head according to the present invention.
Figure 12:
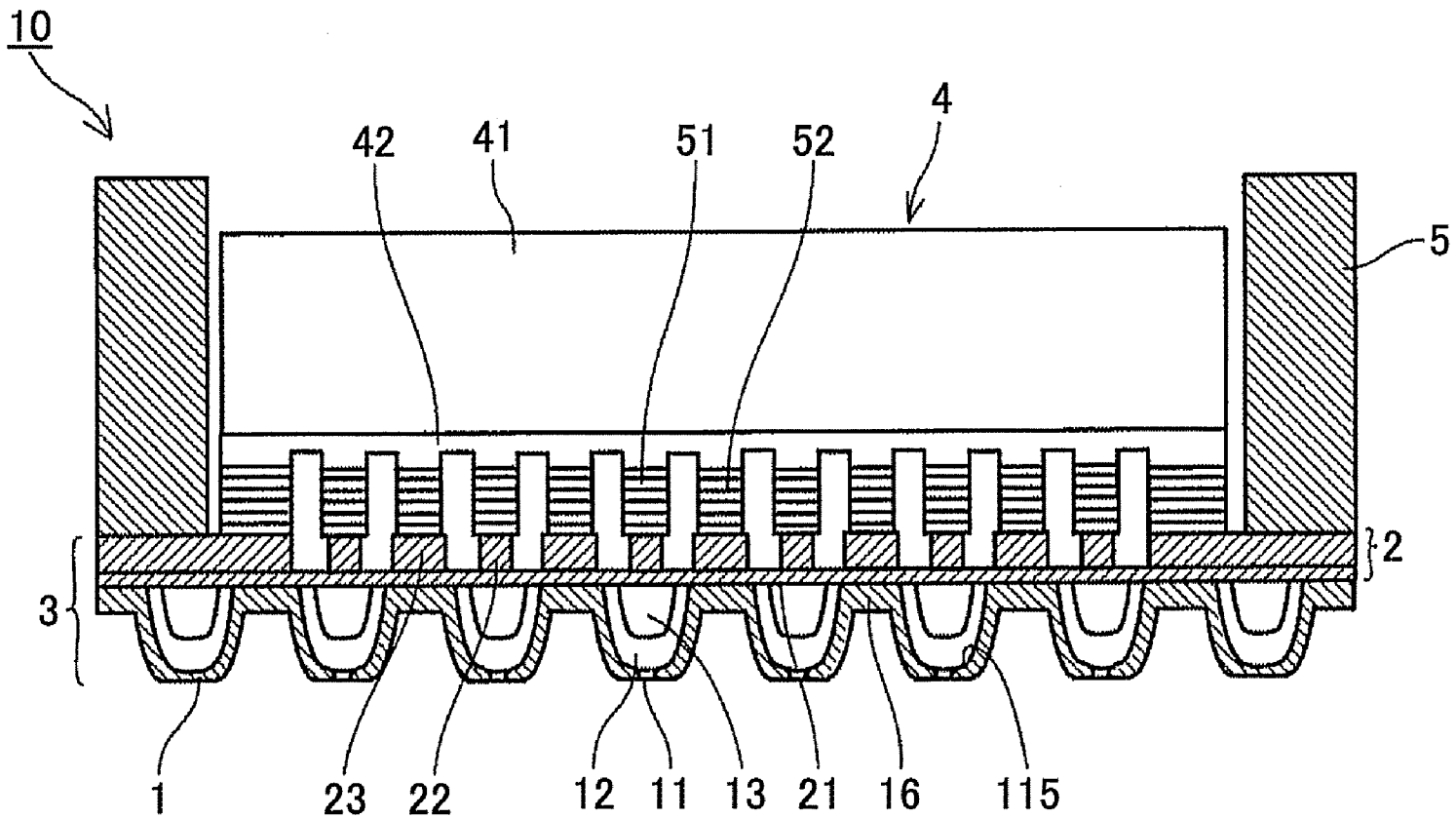
FIG. 12 is a cross-sectional explanatory diagram along the nozzle arrangement direction for the same.

Next, a third embodiment of liquid ejection head according to the present invention is described with reference to FIGS. 11 and 12. FIG. 11 is a cross-sectional explanatory diagram along a direction orthogonal to a nozzle arrangement direction of the same head, while FIG. 12 is a cross-sectional explanatory diagram along the nozzle arrangement direction of the same head.

In the present embodiment, a flow channel plate 1 is used which has a groove-shaped indentation 115 with a shape different from the grooved-shaped indentation 15 of the flow channel plate 1 in the above-described embodiments. Explanations are omitted for the other features, which are the same as in the first embodiment.

In other words, as in the above-described embodiments, the flow channel plate 1, which is a thin plate made of a sheet of metal material, is provided with multiple nozzle holes 11 which eject liquid droplets; pressure generating chambers 12 in communication with the corresponding nozzle holes 11; a fluid resistance section 13 which supplies ink to the pressure generating chamber 12; and an ink introducing section 14 for the fluid resistance section 13.

Here, the pressure generating chamber 12 of the fluid channel plate 1 is formed with the groove-shaped indentation 115 formed from the thin plate, a nozzle hole 11 is formed on one end in the longitudinal direction of the groove-shaped indentation 115, a fluid resistance section 13 is formed on the other end in the longitudinal direction of the groove-shaped indentation 115, an ink introducing section 14 is formed on the other end beyond the fluid resistance section 13, and these pressure generating chamber 12, the nozzle hole 11, the fluid resistance section 13, and the ink introducing section 14 are formed such that the thin plate is deformed in the thickness direction.

The flow channel plate 1 is formed using forging press working, for example. In this case, as shown in FIG. 12, a cross section of the flow channel plate 1 becomes a continuous recess-projection shape, where the recess section, which is the groove-shaped indentation 115, becomes the pressure generating chamber 12 and the fluid resistance section 13 and the ink introducing section 14, while the projecting section becomes a corresponding wall 16.

Figure 13:
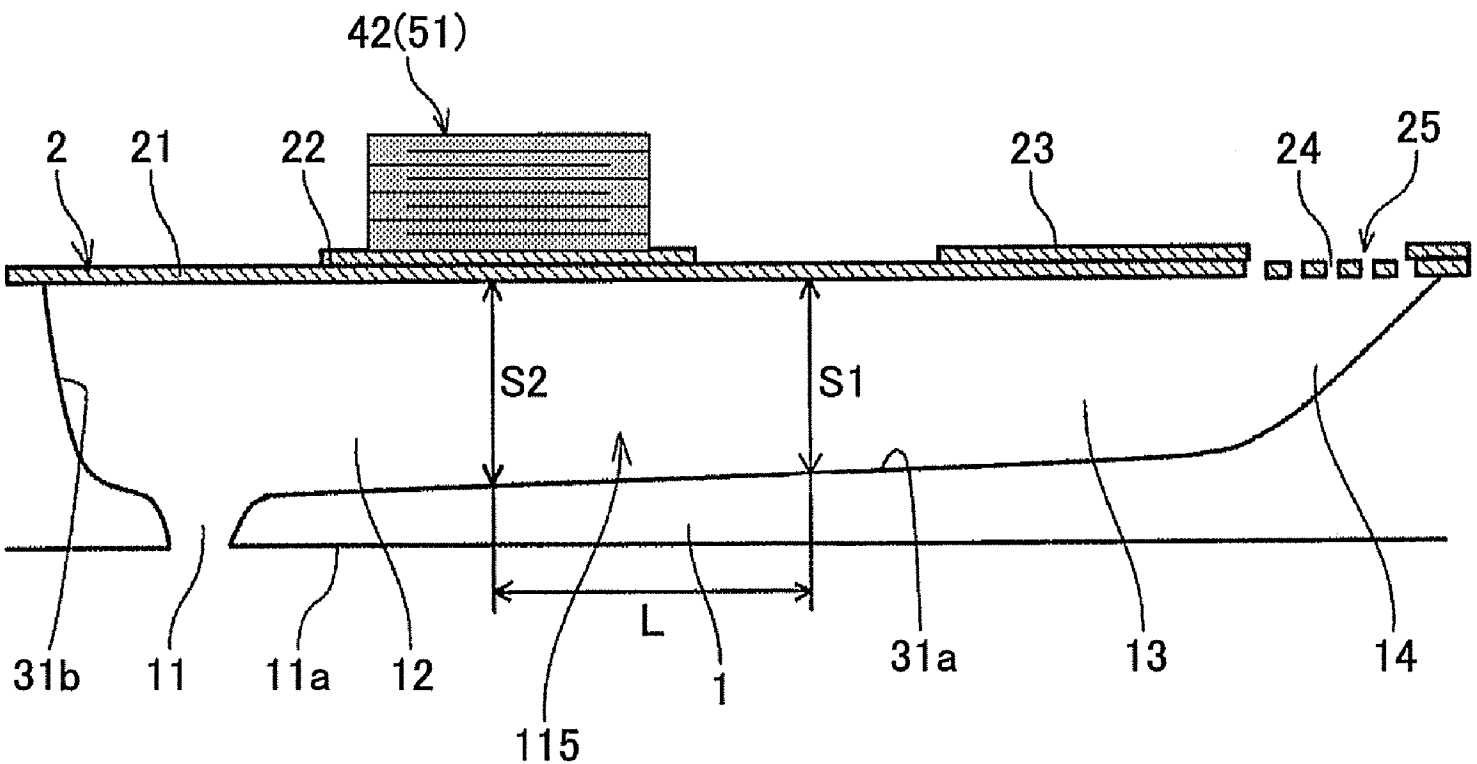
FIG. 13 is an expanded feature explanatory diagram of FIG. 11 for the same.
Figure 14:
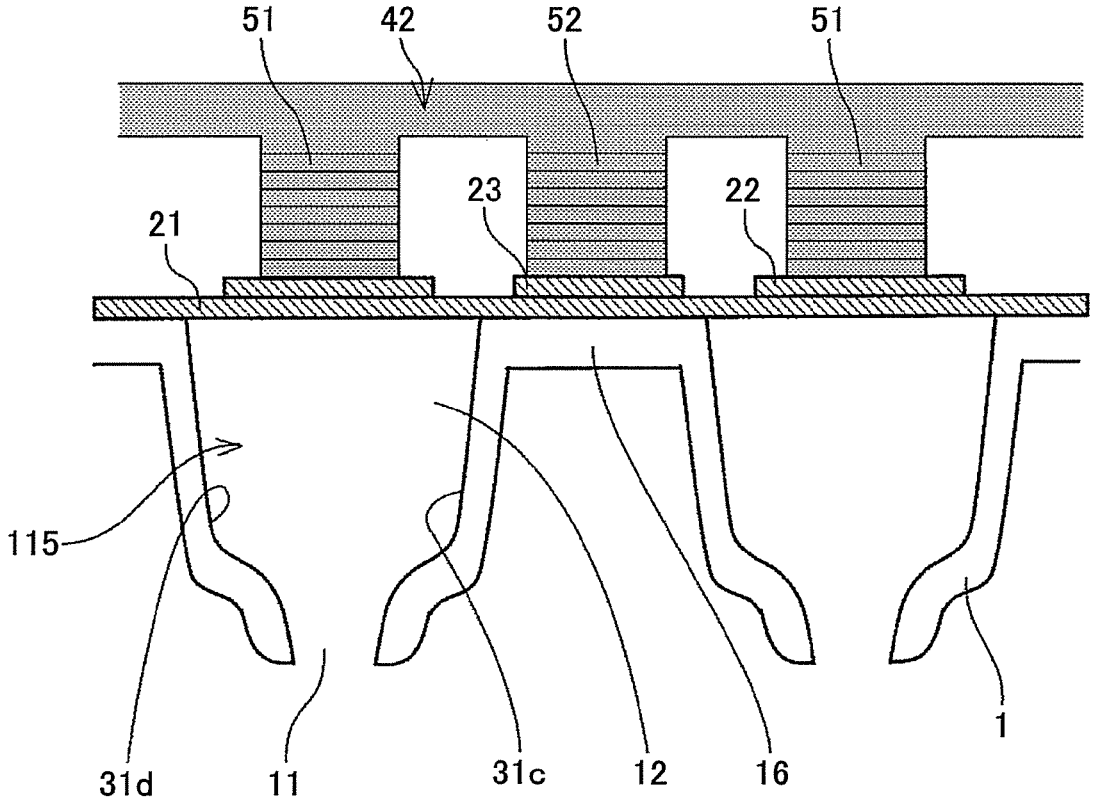
FIG. 14 is an expanded feature explanatory diagram of FIG. 12 for the same.

Then, as also shown in FIGS. 13 and 14, the flow channel plate 1 is, of the wall faces of the flow channel to the nozzle hole 11 from the ink introducing section 14 which is an inlet of the supply channel (flow channel), a wall face on the side of an actuator unit that is arranged (in other words, wall faces

31*a*-31*d* other than wall faces formed with the vibrating plate member 2) with an inclined face which always has an inclination relative to the nozzle face 11 and which continuously changes. In other words, the flow channel plate 1 is shaped such that the tangential direction of the wall face to the nozzle hole 11 from a supply inlet section which supplies ink to the liquid chamber 12 and which continuously changes without it becoming parallel to a nozzle face 11*a*.

In this way, of the wall faces of the flow channel to the nozzle hole 11 from the ink introducing section 14, the wall face on the side the actuator unit is arranged with an inclined face which always has an inclination relative to the nozzle face 11*a* and which constantly changes, so that it is superior in air bubble dischargeability, leading to a reduced likelihood of the ink remaining. Moreover, as there is no opposing face which prevents the ink from flowing and a liquid chamber is shaped to be squeezed in a nozzle face direction, the flow of ink can be concentrated to the nozzle, making it possible to suppress energy loss and to achieve a highly efficient droplet ejection.

As a result of an experiment, it has been found that, in order to prevent the ink from remaining and to increase air bubble dischargeability, the relationship among cross-sectional areas S1, S2, and a distance L between S1 and S2 is preferably set to (S2−S1)/L<=0.18.

Figure 15A:
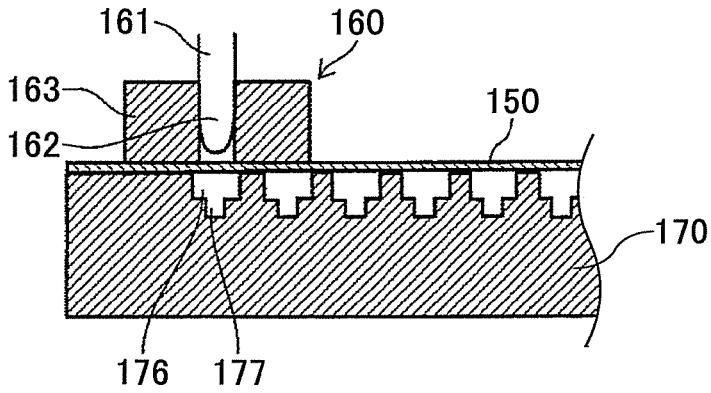
FIGS. 15A through 15D are cross-sectional explanatory diagrams which serve to explain a fifth embodiment of the method of manufacturing the liquid ejection head according to the present invention.
Figure 15B:
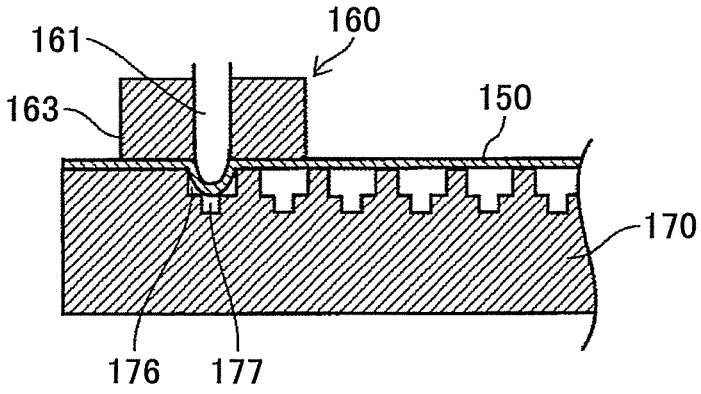

Next, a fifth embodiment of the method of manufacturing the liquid ejection head according to the present invention that forms the flow channel plate of the liquid ejection head according to the third embodiment is described with reference to FIGS. 15A through 16. FIGS. 15A through 15D are cross-sectional explanatory diagrams which serve to explain a process of manufacturing the flow channel plate according to the present embodiment, while FIG. 16 is a cross-sectional diagram which serves to explain a process of opening the same nozzle hole.

A device which manufactures the flow channel plate includes a first upper die 160 and a second upper die 165, and a lower die 170. The first upper die 160 has a punch 161 for a pressure generating chamber that has a projecting section 162 for simultaneously forming the groove-shaped indentation 115 to be the pressure generating chamber 12 and the fluid resistance section 13, and a stripper 163 to be a guide for the punch 161 to move (or slide) up and down. It suffices that there is at least one punch 161. Moreover, the second upper die 165 which is parallel to the first upper die 160 has a punch 166 for a nozzle that has a shape of the nozzle hole 11, and a stripper 167 to be a guide for the punch 166 to move (or slide) up and down.

Here, the projecting section 162 of the punch 161 of the first upper die 160 and a tip of the punch 166 of the second upper die 165 are shaped such that the inclined face which continuously changes toward the nozzle face 11*a* out of wall faces of the flow channel to the nozzle hole 11 from the ink introducing section 14 which is a supply channel (flow channel) inlet section (or in other words, the tangential direction of the wall face to the nozzle hole 11 from the supply inlet section which supplies ink to the pressure generating chamber 12 always has an inclination relative to the nozzle face 11*a*, and such that it slowly changes in a continuous manner without becoming parallel to the nozzle face 11*a*).

The lower die 170 has formed therein a long and narrow groove section 176 which receives the punch 161 of the first upper die 160. On the bottom of the groove section 176 is provided a cylindrically-shaped recess section 177 for the nozzle hole 11. The groove section 176 is structured to have a number of dies, which number corresponds to a least one column of nozzle holes 11 of the head.

Then, as shown in FIG. 15A, a thin plate (below-called "a blank material") which is made of a metal material provided on the lower die 170 is fixed with the stripper 163 of the upper die 160. As shown in FIG, 15B, the punch 161 slides down (in the gravity direction), and the blank material 150 is pushed by the projecting section 162 of the punch 161 into the groove section 176 provided in the lower die 170. In other words, here, press working is performed which is similar to so-called deep drawing. The narrow and long groove-shaped indentation 115 is formed with the process thus far (below called a first process), so that, with the first process, the pressure generating chamber 12, the fluid resistance section 13, and the nozzle introducing section 114 are formed simultaneously.

Figure 15C:
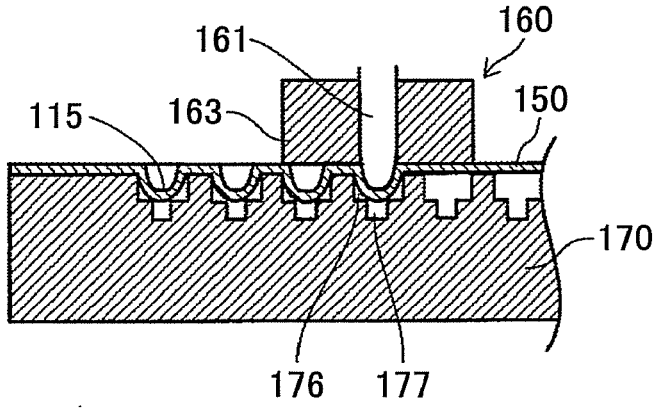
Figure 15D:
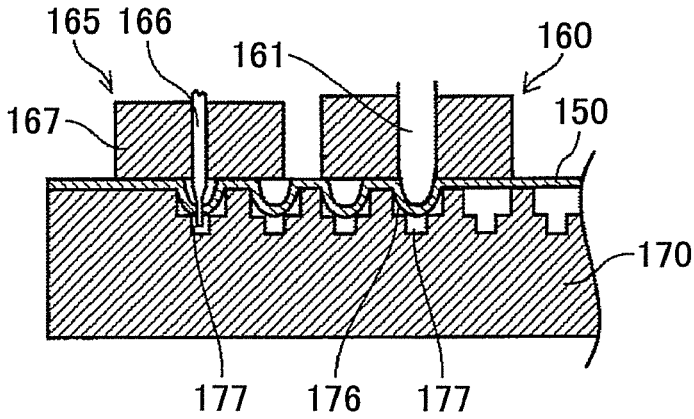
Figure 16:
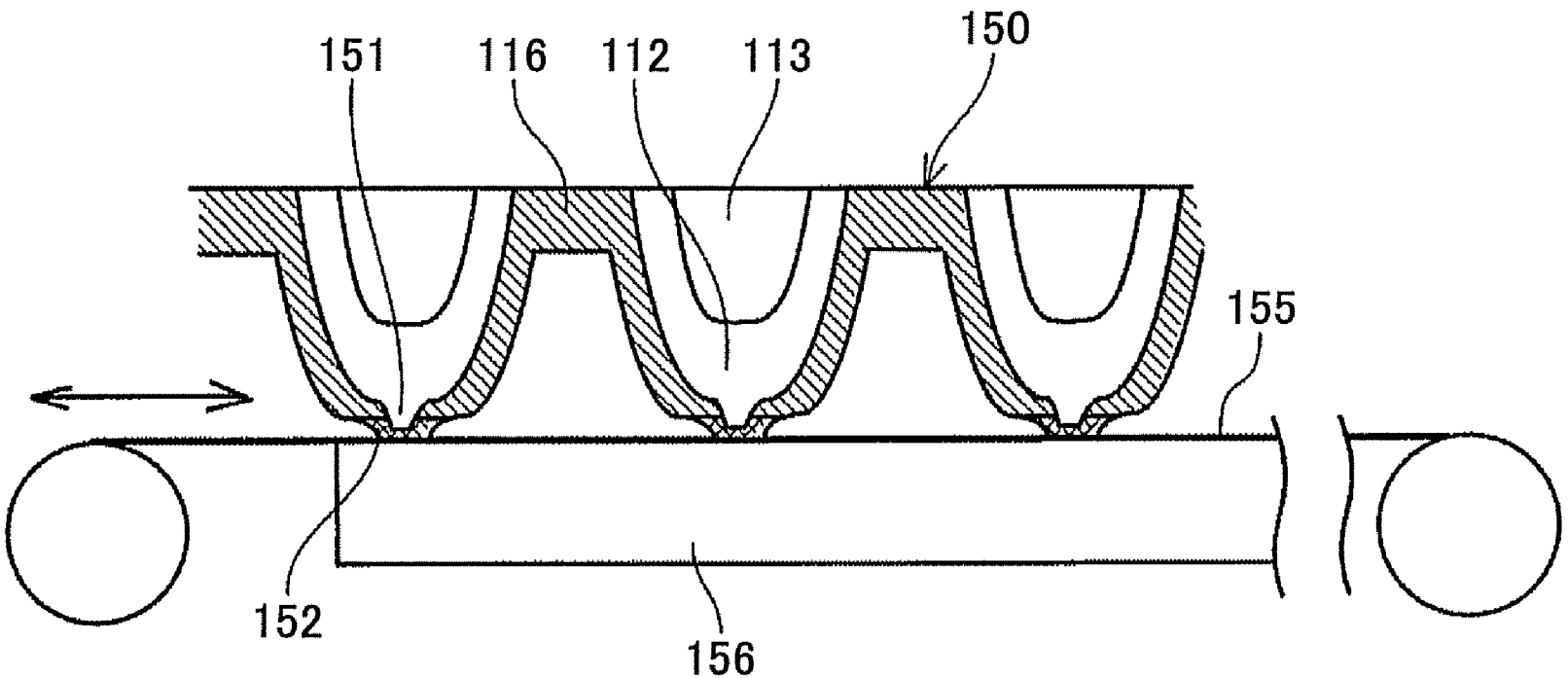
FIG. 16 is an explanatory diagram which serves to explain a process of opening a nozzle hole for the same.

Then, the punch 161 returns to the original position, moves away with the stripper 162 from the blank material 150, and moves to the next press position as shown in FIG. 15C. Such a process as described above is repeated a number of times, so that the groove-shaped indentation 115, which is initially formed reaches immediately below the punch 166 for the nozzle hole 11 that is on the second upper die 165. Here, as shown in FIG. 15D, the punch 166 for the nozzle of the second upper die 165 is pushed into the groove-shaped indentation 115 formed in the above-described first step up to the cylindrically-shaped recess section 177 of the lower die 170. With this second process, a nozzle opening section 152 (see FIG. 16) is formed, inside which is formed a recess section 151 to be a nozzle opening hole 11 on one end side of the groove-shaped indentation 115. Here, the nozzle opening section means a portion where the nozzle hole 11 is to be opened.

Thereafter, the above-described processes shown in FIGS. 15A-15D are repeated, so that the nozzle opening section 152 and the groove-shaped indentation 115 to be the ink introducing section 114, the fluid resistance section 13 and the pressure generating chamber 12 that are needed for the head are formed. The blank material 150 at this stage is not penetrated as the nozzle holes 11.

Then, as shown in FIG. 16, a tip portion (a portion illustrated within a different hatching in FIG. 16) of the nozzle opening section 152 which has a recess section 151 to be a nozzle hole 11 formed by press working is polished and removed to open the nozzle hole 11. The polishing process (nozzle hole opening process) is to be called a third process herein. In the polishing process, the blank material 150 is fixed with a fixture (not shown) and, while lightly pushing a polishing/lapp film 155 against the tip portion of the nozzle opening section 152 with a pushing member (not shown) and while moving the polishing/lapp film 155 both ways in the directions shown with an arrow (alignment directions of the nozzle holes 11), the tip portion of the nozzle opening section 152 is polished, so that the nozzle hole 11 is opened.

Through the above-described first through third processes, a flow channel plate 1 is obtained which has a fluid resistance section 13 and a pressure generating chamber 12 on which a nozzle hole 11 is opened. The blank material 150 (flow channel plate 1) formed by the above-described press working becomes wave-shaped as shown in FIG. 16.

Moreover, although not shown, a face of the flow channel plate 1 that joins the vibrating plate member 2 is polished so as to ensure flatness. This makes it possible to conduct a uniform joining process when the piezoelectric actuator 4 is joined, making it possible to reduce variations among nozzle holes in droplet speed and droplet volume.

Then, the flow channel plate 1 and the vibrating plate member 2 are joined and a piezoelectric actuator 4 and a frame member 5 are joined to obtain the above-described liquid ejection head.

It is preferable that a gap between the punch 161 of the upper die 160 and the groove section 176 of the lower die 170 corresponding thereto is at least greater than the plate thickness of the blank material 150. This is because it suffices to make only the accuracy of the forward feeding of the upper die 160 high, so that the position of the groove section 176 of the lower die 170 may be set at a relatively rough accuracy, making it possible to reduce the die cost. In such a die configuration, the blank material 150 and the lower die 170 are arranged to be fixed with only the first upper die 160 and the second upper die 165 being movable. A method of fixing the blank material 150 to the lower die 170 is not particularly limited, so that the blank material 150 may be located in such a manner as using a pin provided within the lower die 170.

Next, a sixth embodiment of the method of manufacturing the liquid ejection head according to the present invention that forms the flow channel plate of the liquid ejection head according to the third embodiment is described with reference to FIGS. 17A-17D. FIGS. 17A-17D are explanatory diagrams which serve to explain the process of manufacturing the flow channel plate according to the same embodiment.

Here, a die 172 having formed thereon a groove section 176 and a recess section 177 is arranged such that it is movable up and down, making the upper dies 160 and 165, and the lower die 170 be a pair of die structures, thus achieving a reduced sized die.

Figure 17A:
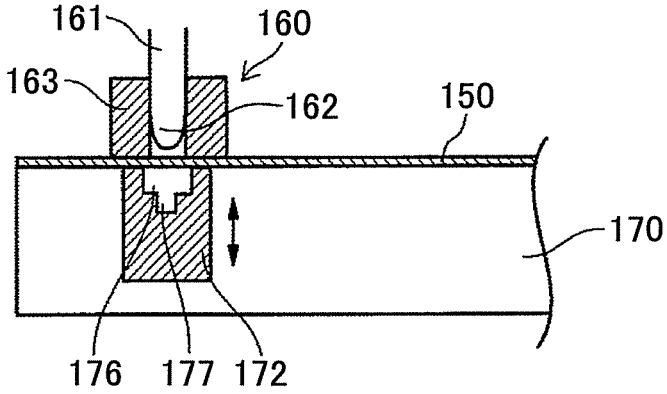
FIGS. 17A through 17D are cross-sectional explanatory diagrams which serve to explain a sixth embodiment of the method of manufacturing the liquid ejection head according to the present invention.
Figure 17B:
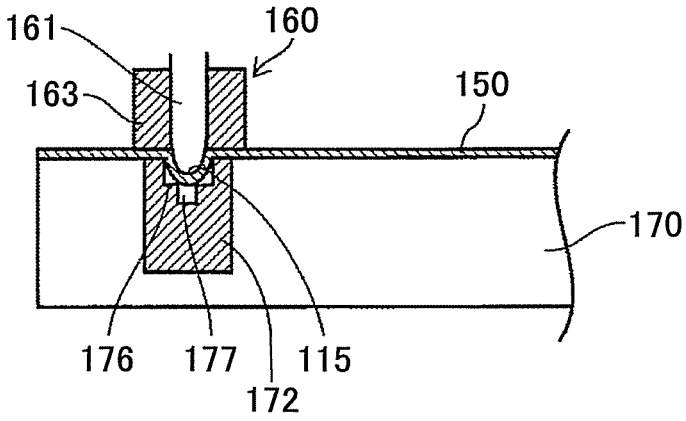
Figure 17C:
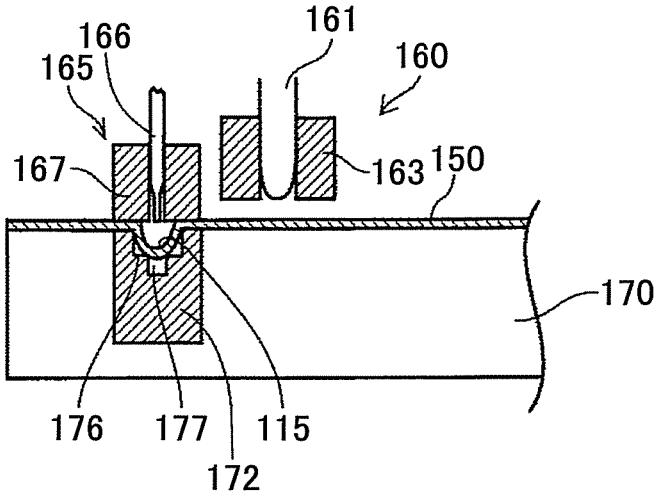
Figure 17D:
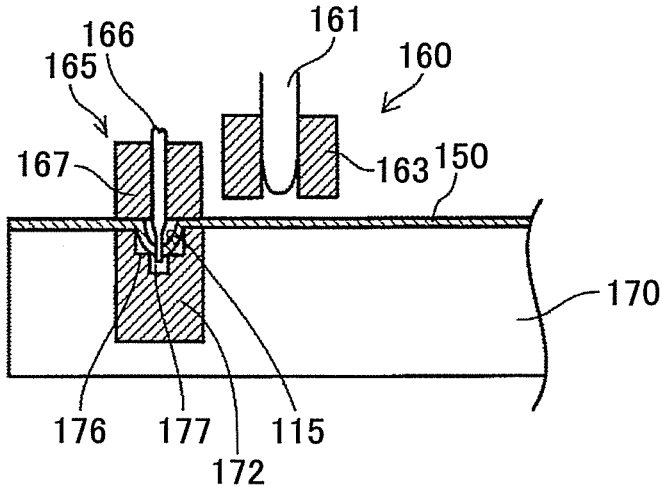

In this embodiment, the manufacturing process of the flow channel plate 1 is performed using the first process or the third process as in the fifth embodiment. In other words, first, as shown in the states from FIG. 17A to FIG. 17B, a narrow and long groove-shaped indentation 115 to be the pressure generating chamber 12, the fluid resistance section 13, and the ink introducing section 14 is formed with the upper die 160. Next, as shown in FIG. 17C, the first upper die 160 slides up and the second upper die 165 moves to a location opposing the die 172 of the lower die 170. Then, in the second process, as shown in FIG. 17D, the punch 166 for the nozzle moves down, so that it is pushed into the recess section 177 provided on the groove section 176 of the die 172 of the lower die 170. In this way, a nozzle opening section 152 on which a recess section to be the nozzle hole 11 is formed. Such a process can continuously be repeated to manufacture a blank material 150 before the nozzle hole 11 penetrates therethrough.

Thereafter, as in the fifth embodiment, the nozzle hole 11 of the nozzle opening section 152 is opened in the polishing process.

Next, a seventh embodiment of the method of manufacturing the liquid ejection head according to the present invention that forms the flow channel plate of the liquid ejection head according to the third embodiment is described.

In the above-described fifth and sixth embodiments, the groove-shaped indentation 115 to be the pressure generating chamber 12 is formed earlier than the nozzle opening section 152 for the nozzle hole 11. In this case, the amount of strokes for pushing in the punch 166 of the nozzle hole becomes longer.

Then, in the seventh embodiment, the process of punching the nozzle hole that is a second process of the fifth and sixth embodiments (the process as shown in FIG. 15D and FIG. 17D, for example) is called a first process in which the nozzle opening section 152 which corresponds to a nozzle hole 11 is necessarily formed first. Next, as the second process, as described in FIG. 16, a tip portion of the nozzle opening section 152 formed first with the punch 166 is polished to open the nozzle hole 11. With the polishing process, the blank material 150 becomes a flat plate again. Then, as the last and the third process, the groove-shaped indentation 115 to be the pressure generating chamber 12 and the fluid resistance section 13, etc., is formed (e.g., processes in FIG. 15B and FIG. 17B). In this case, in respective first and second processes, upper die and lower die are provided as a pair on a dedicated basis.

Figure 18:
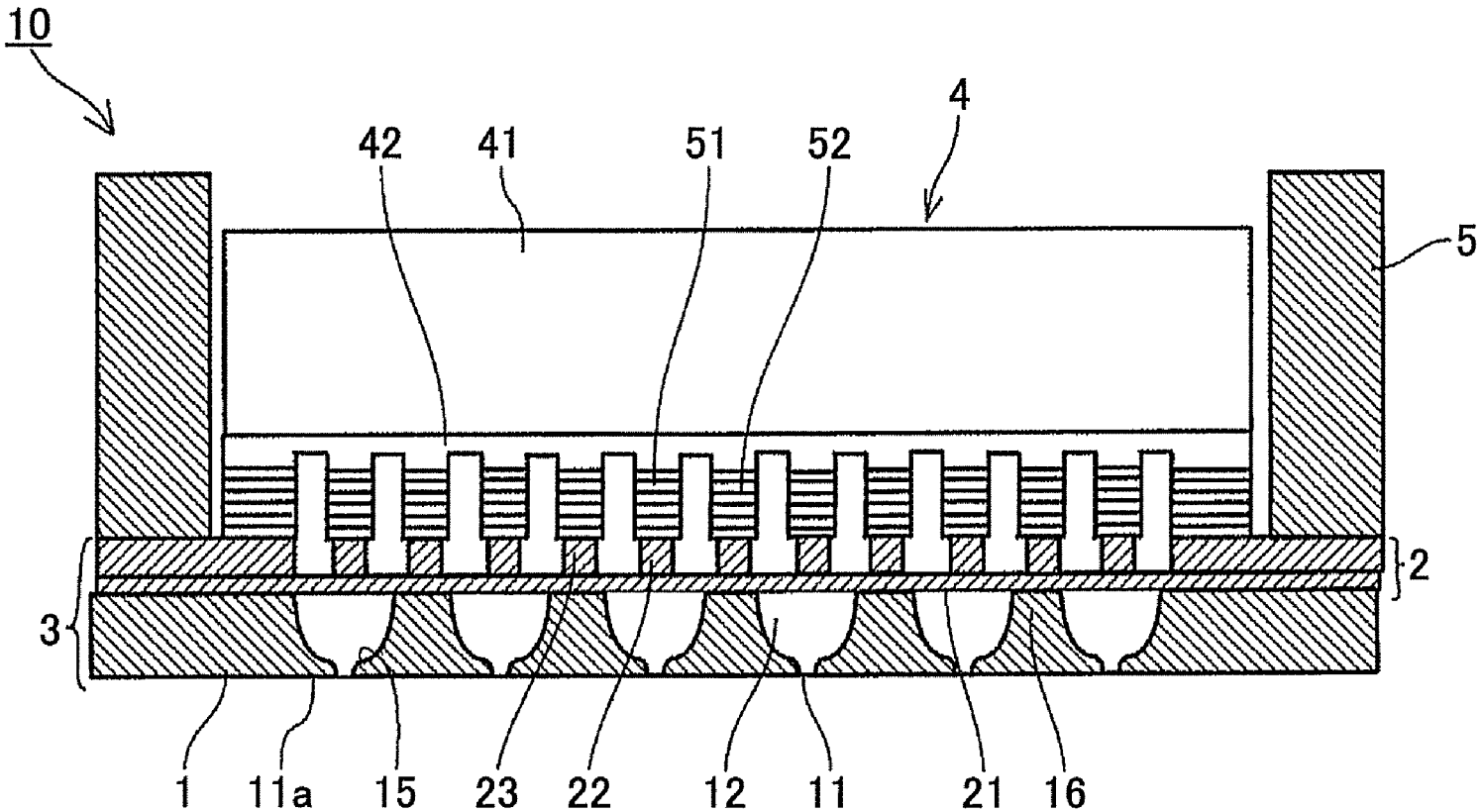
FIG. 18 is a cross-sectional explanatory diagram along the nozzle arrangement direction that serves to explain a fourth embodiment of the liquid ejection head according to the present invention.

Next, a fourth embodiment of the liquid ejection head according to the present invention is described with reference to FIG. 18. FIG. 18 is a cross-sectional explanatory diagram along a nozzle arrangement direction of the same head.

The flow channel plate 1 of the liquid ejection head is formed by a half pierce work process which is one of the press working processes. In other words, after the pressure generating chamber 12 is formed, the nozzle hole 11 is formed by forging. The previously-described arrangement also makes it possible to achieve the same operational advantage as the first embodiment.

Next, an eighth embodiment of the method of manufacturing the liquid ejection head according to the present invention that forms the flow channel plate of the liquid ejection head according to the fourth embodiment is described with reference to FIGS. 19A-19D. FIGS. 19A-19D are explanatory diagrams which serve to explain the process of manufacturing the flow channel plate according to the same embodiment.

First, a manufacturing apparatus has a first upper die 180 and a lower die 190. The first upper die 180 has a punch 181 for a pressure generating chamber that has a projecting section 182 for simultaneously forming the groove-shaped indentation 115 to be the pressure generating chamber 12 and the fluid resistance section 13, and a stripper 183 to be a guide for the punch 181 to slide up and down. It suffices that there is at least one punch 181. The lower die 190 is arranged to be a die structure having the same number of recess sections 196 for receiving the punch 181. The recess section 196 is shaped as a narrow and long groove. As described previously, the projecting section 182 of the punch 181 is shaped such that the inclined face continuously changes toward the nozzle face 11*a* out of wall faces of the flow channel to the nozzle hole 11 from the ink introducing section 114 which is a supply channel (flow channel) inlet section (or in other words, the tangential direction of the wall face to the nozzle hole 11 from the supply inlet section which supplies ink to the pressure generating chamber 12 always has an inclination relative to the nozzle face 11*a*, such that it slowly changes in a continuous manner without becoming parallel to the nozzle face 11*a*).

Figure 19A:
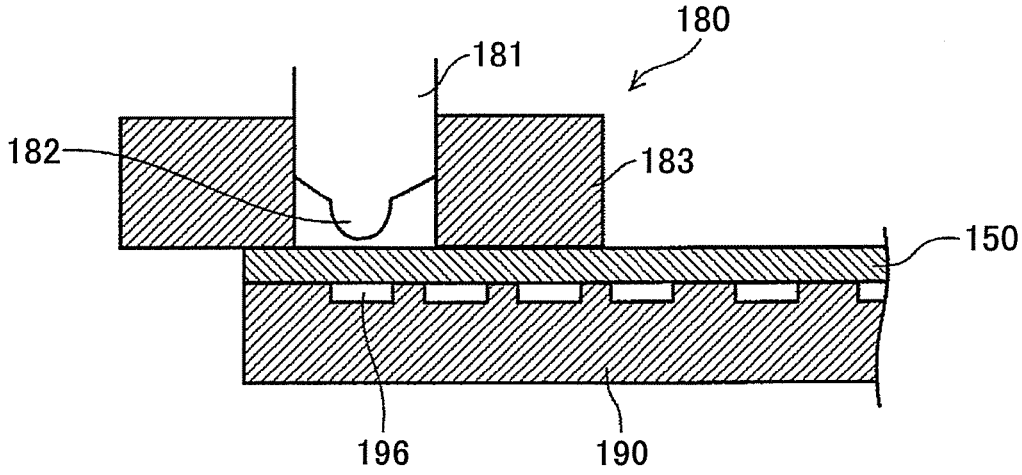
FIGS. 19A through 19D are cross-sectional explanatory diagrams which serve to explain an eighth embodiment of the method of manufacturing the liquid ejection head according to the present invention.
Figure 19B:
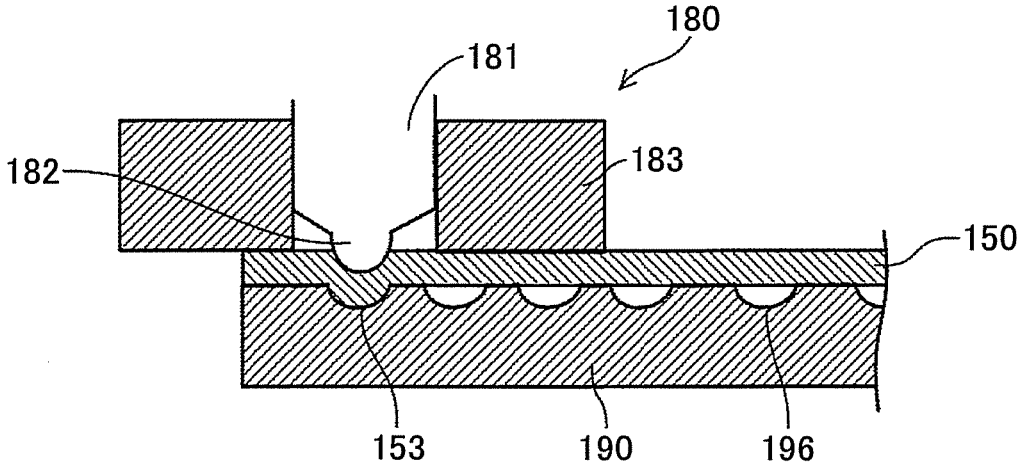

Then, as shown in FIG. 19A, the blank material 150 (the thickness of which is greater than that in the fourth embodiment) provided on the lower die 190 is fixed with a stripper 183 of the upper die 180. From this state, the punch 181 slides down, so that, as shown in FIG. 19B, the blank material 150 is pushed into the recess section 196 provided in the lower die 190. Then, the pushing in of the punch 181 is stopped at a location such that the amount of being pushed in becomes less than the plate thickness of the blank material 150. Moreover, unlike the fourth embodiment, the gap between the punch 181 and the recess section 196 is not more than the plate thickness, and is a gap of approximately 3 μms, for example. The narrow and long groove-shaped indentation 115 is formed with a process thus far (below called a first process), so that, with the first process, a narrow and long groove-shaped indentation 115 to be the pressure generating chamber 12 and the fluid resistance section 13 is formed.

Figure 19C:
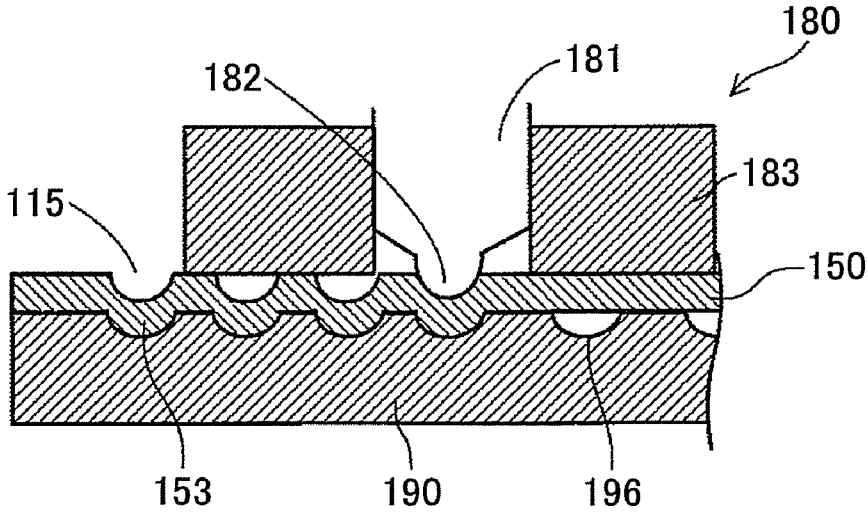

Thereafter, the punch 181 returns, moves away from the blank material 150 with the stripper 182, and, as shown in FIG. 19C, moves to the next press location, so that once again the punch 181 is pushed in. The press working in FIGS. 19A through 19C are repeated to form the groove-shaped indentations 115 which form the pressure generating chambers 12 and the fluid resistance sections 13 that are needed for the head. The blank material 150 in this state is such that the projecting section 153 to be a face of the nozzle hole 11 and a recess section (the groove-shaped indentation 115) on the pressure generating chamber 12 side are formed, but the nozzle hole 11 is not formed.

Figure 19D:
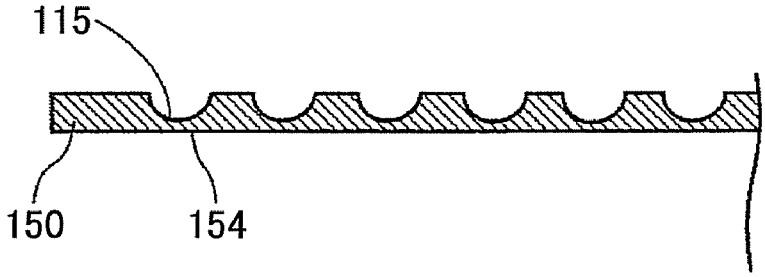

Next, of the projecting section 153 and the recess section (groove-shaped indentation 115) formed by the above-described press working, only the projecting section 153 is polished to finish a face which forms the nozzle hole 11 substantially flat. The previously-described process is to be called a second process. With this process, as shown in FIG. 19D, a thin wall section 154 which opposes the pressure generating chamber 12 is formed and a portion corresponding to the nozzle plate is formed integrally with the flow channel plate 101. Then, a nozzle opening section which forms the nozzle hole 11 is formed on the thin wall section 154 by a press process using forging. While not shown, it may be processed in a method similar to that used in the above-described FIG. 15D, for example. The previously-described process is to be called a third process. Thereafter, with a fourth process which polishes the projecting section with the method shown in FIG. 16, the flow channel plate 101 on which the nozzle hole 11 and the pressure generating chamber 12 are integrally formed is obtained.

Figure 20:
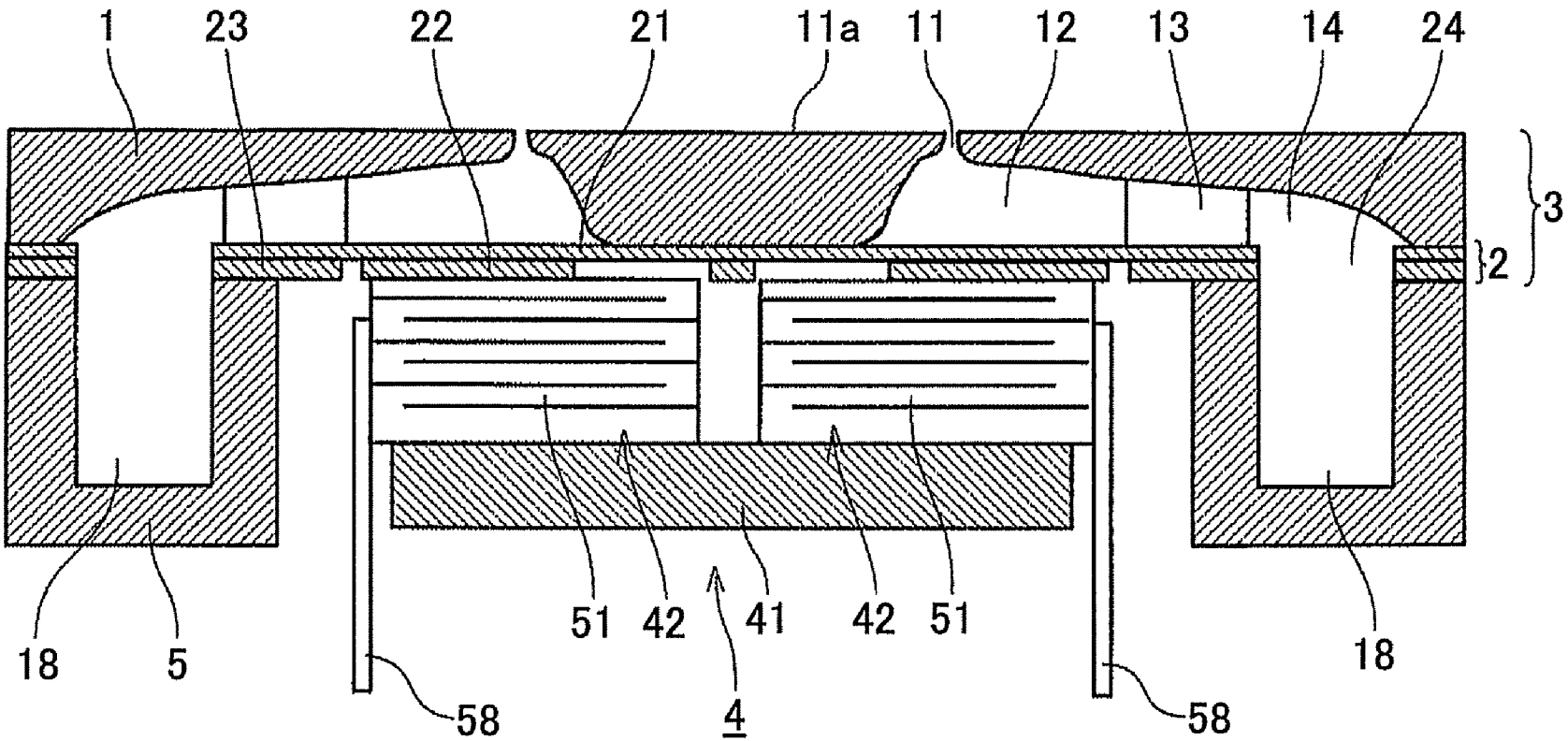
FIG. 20 is a cross-sectional explanatory diagram along the nozzle arrangement direction that serves to explain a fifth embodiment of the liquid ejection head according to the present invention.

Next, a fifth embodiment of the liquid ejection head according to the present invention is described with reference to FIG. 20. FIG. 20 is a cross-sectional explanatory diagram along a direction (liquid chamber longitudinal direction) which is orthogonal to a nozzle arrangement direction of the same head.

The liquid ejection head, which is an arrangement of two columns of the nozzle hole 11, may be arranged to be any of the embodiments for the other features, so that the explanation is omitted.

Figure 21:
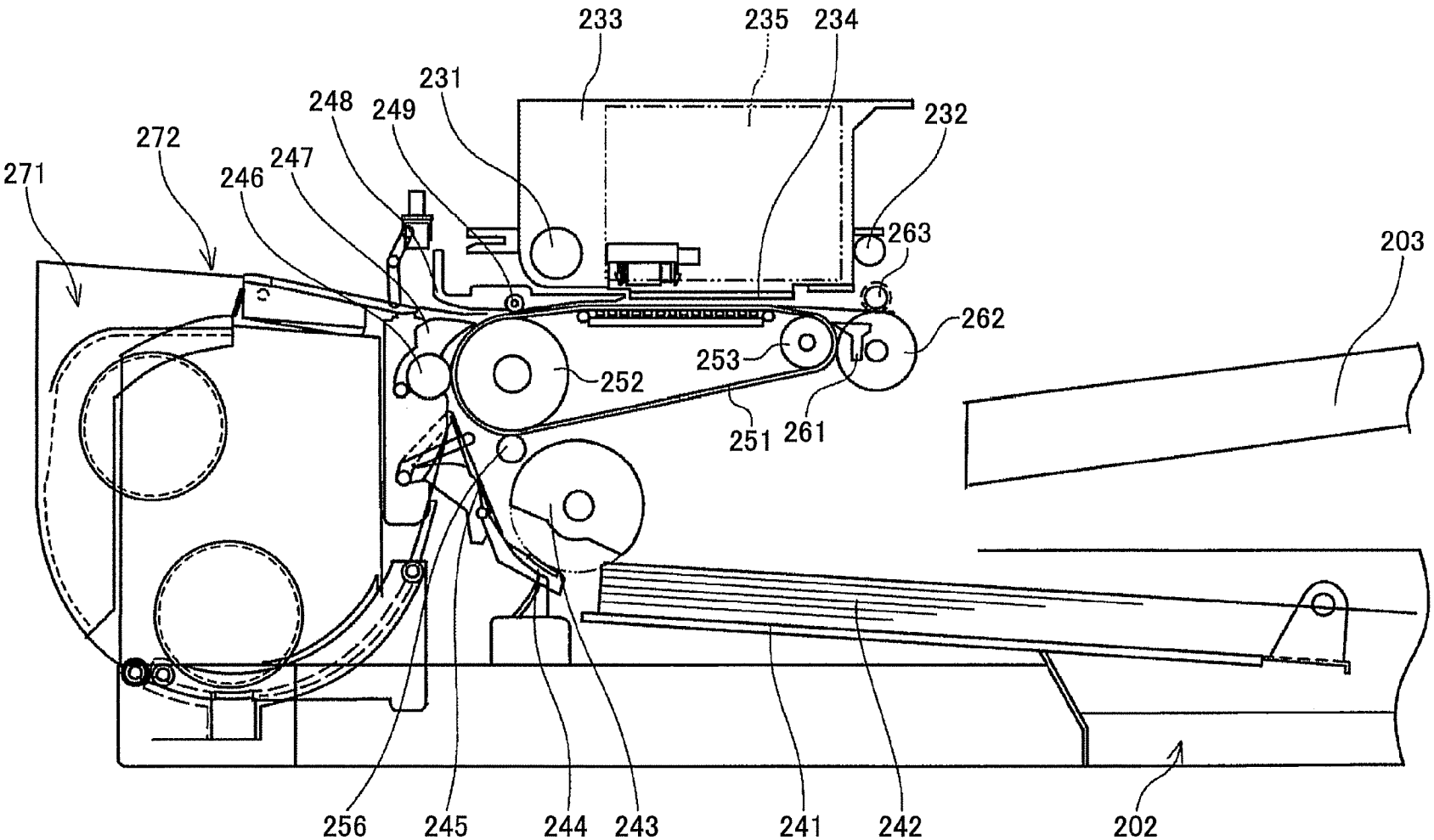
FIG. 21 is a diagram illustrating an overview configuration of one example of an image forming device according to the present invention.
Figure 22:
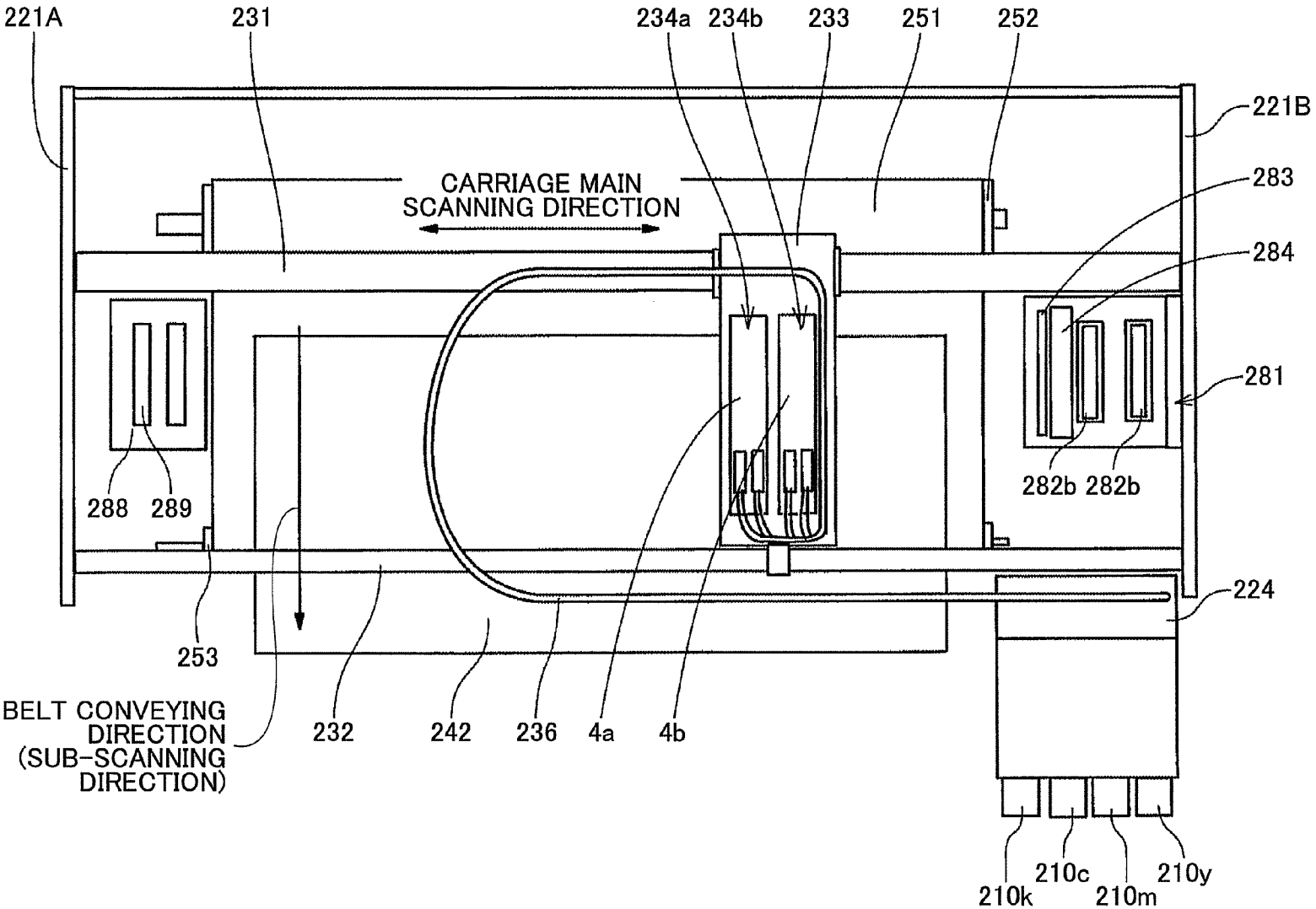
FIG. 22 is a feature plane explanatory diagram for the same.

Next, an example of an image forming device according to the present invention that includes the liquid ejection head according to the present invention is described with reference to FIGS. 21 and 22. FIG. 21 is a schematic configuration diagram which explains an overall configuration of a machinery section of the device, while FIG. 22 is a feature plane explanatory diagram of the machinery section.

This image forming device is a serial-type image forming device, where, a carriage 233 is held to be able to slide freely on main and sub guiding rods 231 and 232, which are guiding members bridged across left and right side plates 221A and 221B and moves and scans, driven by a main-scanning motor (not shown) in the directions shown with an arrow (carriage main-scanning direction) via a timing belt.

The carriage 233 has recording heads 234 including liquid ejection heads according to the present invention that are for ejecting ink droplets of colors of yellow (Y), cyan (C), magenta (M), and black (Y), and liquid ejection head units which have integrated therewith tanks which carry ink to be supplied to the heads, the recording heads having a nozzle sequence including multiple nozzles that is arranged in a sub scanning direction which is orthogonal to the main scanning direction and being mounted with the ink droplet discharging direction facing downward.

The recording heads 234 are arranged to have liquid ejection head units 234*a* and 234*b*, which have respectively two nozzle sequences, mounted on one base member. One of the nozzle sequences of the recording head 234*a* ejects black (K) liquid droplets, the other of the nozzle sequences of the recording head 234*a* ejects cyan (C) liquid droplets; and one of the nozzle sequences of the recording head 234*b* ejects magenta (M) liquid droplets, and the other of the nozzle sequences of the recording head 234*b* ejects yellow (Y) droplets. Here, while it is arranged for two heads to eject four colors of liquid droplets, it may be arranged for one head to eject four different colors using an arrangement having a sequence including four nozzles per head.

Moreover, ink of each color is supplied to a tank 235 of the recording head 234 from an ink cartridge 210 of the corresponding color by a supply unit 224 via a supply tube 236 of the corresponding color.

On the other hand, as a paper-supply section for supplying sheets 242 loaded on a sheet loading section 241 (a pressure plate) for a paper-supply tray 202, there are provided a crescent roller (a paper-supply roller) 243 which feeds, on a sheet by sheet basis, the sheets 242 from the sheet loading section 241, and a separation pad 244 which opposes the paper-supply roller 243 and which is made of a material of a high coefficient of friction, which separation pad 244 is biased to the paper-supply roller 243 side.

Then, in order to feed, into the lower side of the recording head 234, the sheets 242 supplied from the paper-supply section, a guide member 245 which guides the sheets 242, a counter roller 246, a conveying guide member 247, and a pressing member 248 which has a tip pressure roller 249, as well as a conveying belt 251, which is a conveying unit for electrostatically adsorbing the sheets 242 supplied, to convey the electrostatically adsorbed sheets 242 to a location opposing the recording head 234.

This conveying belt 251, which is an endless belt, is arranged to be stretched between a conveying roller 252 and a tension roller 253 to revolve in the belt-conveying direction (sub-scanning direction). Moreover, a charging roller 256 is provided which is a charging unit for charging the surface of the conveying belt 251. This charging roller 256, which is in contact with a surface of the conveying belt 251, is arranged such that it rotates following a rotational movement of the conveying belt 251. This conveying belt 251 moves circularly in the belt conveying direction by the conveying roller 252 being rotationally driven via a timing unit by a sub-scanning motor (not shown).

Moreover, as a paper-output section for outputting sheets 242 recorded with the recording head 234, a separating claw 261 for separating the sheets 242 from the conveying belt 251, and a paper-output roller 262 and a paper-output roller 263 are provided, and a paper-output tray 203 is provided below the paper-output roller 262.

Furthermore, a double face unit 271 is removably mounted on a back face section of the device body. This double face unit 271 takes in sheets 242 returned in a reverse direction rotation of the conveying belt 251 to reverse the sheets so as to supply the sheets again between the counter roller 246 and the conveying belt 251. Moreover, the upper face of this double face unit 271 is arranged to be a manual bypass tray 272.

Furthermore, in a non-printing area of one side of the scanning direction of the carriage 233, a maintenance and recovery mechanism 281 is arranged which includes a recovery unit for maintaining and recovering a state of the nozzles of the recording head 234. This maintenance and recovery mechanism 281 is provided with capping members 282*a*-282*d* (below called "cap"; called "cap 282" when not distinguishing therebetween) for capping each of the nozzle faces of the recording head 234, a wiper blade 283, which is a blade member for wiping the nozzle faces, and a non-contributing ejection receiver 284 for receiving liquid droplets ejected which do not contribute to recording in order to discharge recording liquid with increased viscosity.

Moreover, in a non-printing area of the other side of the scanning direction of the carriage 233, a non-contributing ejection receiver 288 is arranged which receives liquid droplets when liquid droplets which do not contribute to recording are ejected in order to discharge recording liquid with viscosity that has increased during recording, etc., the non-contributing ejection receiver 288 being provided with an opening section 289 along a nozzle sequence direction of the recording head 234.

In the image forming device of the present invention that is arranged as described above, the sheets 242 are supplied from the paper-supply tray 202 on a sheet by sheet basis, the sheets 242 supplied substantially vertically upward are guided by the guide 245, placed between the conveying belt 251 and the counter roller 246 to be conveyed, have tips thereof guided with the conveying guide 237 to be pressed against the conveying belt 251 with the tip pressurizing roller 249, and have the conveying direction turned substantially 90 degrees.

Then, an alternate repetition of a positive output and a negative output, or in other words, an alternate voltage is applied to the charging roller 256, so that the conveying roller 251 is charged in alternating voltage charge patterns, or, in other words, alternately charged in a shape of positive and negative voltage bands in a predetermined width in a sub-scanning direction, which is a circularly rotating direction. The sheets 242, when fed onto the conveying belt 251 alternately charged positive and negative, are adsorbed to the conveying belt 251, and conveyed in the sub-scanning direction by a circular rotational movement of the conveying belt 251.

Then, the recording head 234 is driven according to an image signal while moving the carriage 233 to discharge ink droplets onto the individual sheets 242 at rest to record what amounts to one line, and recording for the following line is performed after the sheets 242 are conveyed for a predetermined amount. When a recording termination signal or a signal that a trailing edge of the sheet 242 has reached the recording area is received, the recording operation is terminated, so that the sheets 242 are output to the paper-output tray 203.

In this way, in the image forming device, a liquid ejection head according to the present invention is provided as a recording device, making it possible to achieve a decreased cost and an increased length of the head.

Figure 23:
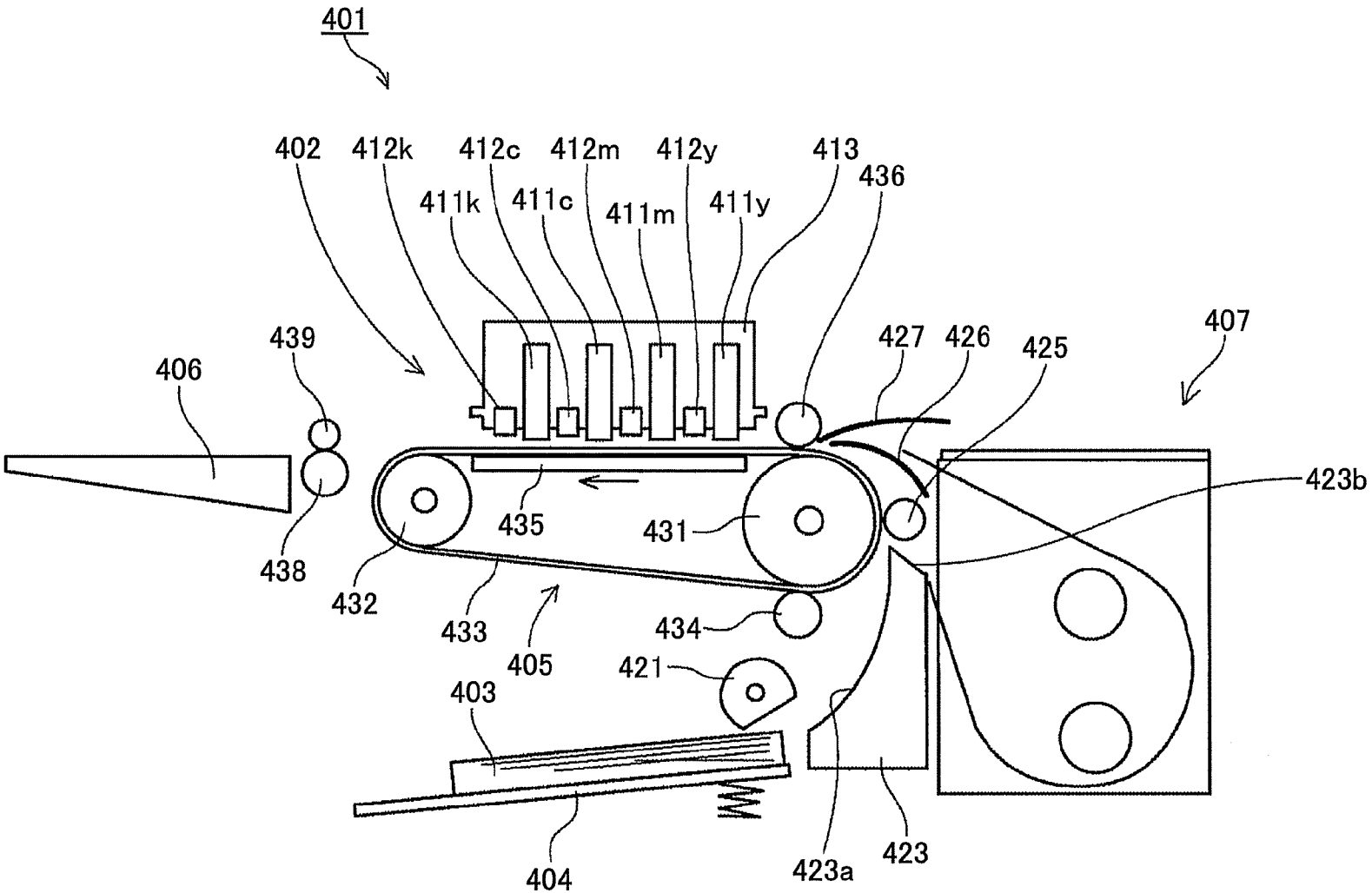
FIG. 23 is a schematic configuration diagram for the entirety of a machinery section that shows another example of the image forming device according to the present invention.

Next, an example of an image forming device according to the present invention that includes the liquid ejection head according to the present invention is described with reference to FIG. 23. FIG. 23 is a schematic configuration diagram of an overall machinery section of the same device.

The image forming device, which is a line-type image forming device, has an image forming section 402, etc., inside the device body 401, and includes a paper-supply tray 404 which can load a large number of sheets of recording media (sheets) 403 on the lower side of the device body 401. The image forming device takes in the sheets 403 supplied from the paper-supply tray 404, records desired images with the image forming section 402 while conveying the sheets 403 with a conveying mechanism 405, and then discharges the sheets 403 onto the paper-discharge tray 406 mounted on the side of the device body 401.

Moreover, a double face unit 407 is provided which is removable with respect to the device body 401. When the double face printing is conducted, after completing a single face (surface) print, the sheets 403 are taken into the double face unit 407 while being conveyed in the reverse direction by the conveying mechanism 405, and reversed so that they are again sent into the conveying mechanism 405 with the other face (back face) being the face on which printing is possible. After the printing of the other face (back face) is completed, the sheets 403 are discharged to the paper-discharge tray 406.

Here, the image forming section 402 includes recording heads 411*y*, 411*m*, 411*c*, and 411*k* (called "recording heads 411" when not distinguishing among colors) which have four line-type liquid ejection heads according to the present invention that eject liquid droplet of the corresponding colors of yellow (Y), magenta (M), cyan (C), and black (K), for example. The liquid ejection heads have integrally formed subtanks, each of which supplies ink to the corresponding liquid ejection head, and each of the recording heads 411 is mounted to the head holder 413 with a nozzle face which forms the nozzles ejecting the liquid droplet facing downwards.

Figure 24:
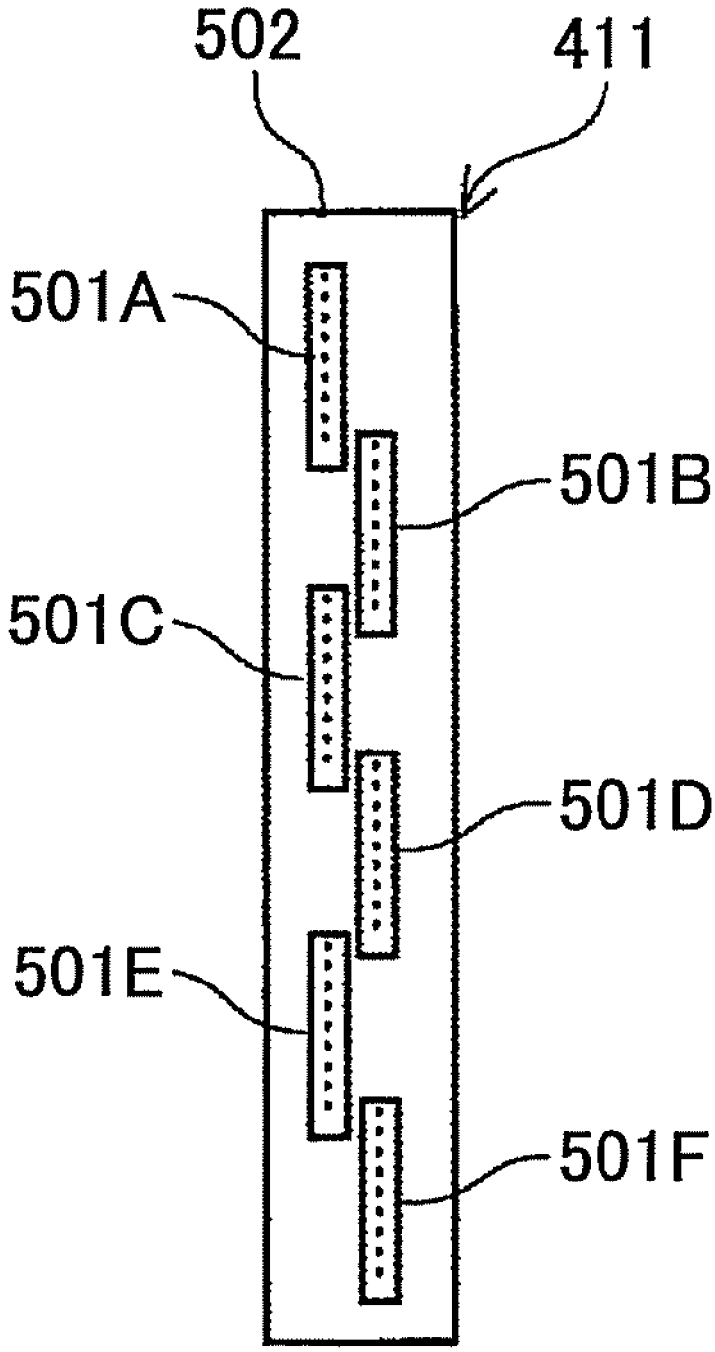
FIG. 24 is an explanatory diagram for a recording head for the same device.

As shown in FIG. 24, one recording head 411 is configured such that multiple (six in this example) subtank-integrated liquid ejection heads 501A-501F according to the present invention are arranged on a base member 502 at a certain positional relationship, but it may also be configured to have one full-line type liquid ejection head.

Moreover, maintenance and recovery mechanisms 412*y*, 412*m*, 412*c*, and 412*k* (called "maintenance and recovery mechanisms 412" when not distinguishing among colors) are provided for maintaining and recovering head performance with the corresponding recording heads 411. At the time of operation of maintaining the head performance such as purging and wiping, the recording heads 411 and the maintenance and recovery mechanisms 412 are mutually moved, and capping members which make up the maintenance and recovery mechanisms 412 are arranged to oppose the nozzle faces of the recording heads 411.

With the paper-supply roller (crescent roller) 421 and the separation pad (not shown), sheets 403 of the paper-supplying tray 404 are separated on a sheet by sheet basis, supplied into the device body 401, sent in between the conveying belt 433 and the regist roller 425 along the guide face 423*a* of the conveying guide member 423, and sent onto the conveying belt 433 of the conveying mechanism 405 via the guide member 426 at a certain timing.

Moreover, a guide face 423*b* which guides a sheet 403 sent out from the double face unit 407 is also formed on the conveying guide member 443. Furthermore, a guide member 427 is also arranged which guides, to the double face unit 407, the sheet 403 returned from the conveying mechanism 405 at the time of double face printing.

The conveying mechanism 405 includes an endless conveying belt 433 which is stretched across a follower roller 432 and a conveying roller 431, which is a driving roller; a charging roller 434 for charging the conveying belt 433; a platen member 435 which maintaining the plane characteristic of the conveying belt 433 at a portion opposing an image forming section 402; a pressing roller 436 which presses, onto the conveying roller 431 side, the sheet 403 sent out from the conveying belt 433; and a cleaning roller (not shown) which includes a multiporous material that is a cleaning unit for removing recording liquid (ink) adhered to the conveying belt 433. As a conveying mechanism, what adsorbs a recording medium to the conveying belt by air absorption, etc., may also be used.

Downstream the conveying mechanism 405 is provided a spur 439 and a paper-discharge roller 438 for sending out, onto a paper-discharge tray 406, a sheet 403 on which an image is recorded.

In the image forming device which is configured as described above, the conveying belt 433 moves circularly in the direction shown with an arrow, and is charged by coming into contact with the charging roller 434 to which a high-potential voltage is applied, so that, when the sheet 403 is supplied onto the charged conveying belt 433, the sheet 403 is electrostatically adsorbed to the conveying belt 433. In this way, the sheet 403 which is strongly adsorbed to the conveying belt 433 is corrected for warping and unevenness, so that a nearly flat face is formed.

Then, the conveying belt 433 moves the sheet 403 and liquid droplets are ejected from the recording heads 411 to form a required image on the sheet 403, so that the sheet 403 on which the image is recorded is discharged to the discharge tray 406 with the discharge roller 438.

In this way, in the image forming device, the liquid ejection head according to the present invention is provided, making it possible to achieve a reduced cost and an increased speed.

While the present invention has been described in the above-described embodiments with examples applied to an image forming device of a printer configuration, it is not limited thereto, so that, as described above, it may be applied to an image forming device such as a machine which includes multiple functions of printer/facsimile machine/copier, etc. and also to an image forming device which uses liquid or fixing solution, which is other than the narrowly-defined term of ink.

The present application is based on Japanese Priority Applications No. 2009-206379 filed on Sep. 7, 2009, No. 2009-212882 filed on Sep. 15, 2009, and No. 2010-145710 filed on Jun. 26, 2010, the entire contents of which are hereby incorporated by reference.

The invention claimed is:

1. A liquid ejection head including a flow channel plate, the flow channel plate being formed of a thin plate, the flow channel plate being formed with one or more pressure generating chambers, a fluid resistance section which supplies liquid to the pressure generating chamber, and a nozzle hole which opposes the pressure generating chamber, wherein the flow channel plate is made of a metal material, and wherein the flow plate comprises:

the pressure generating chamber which is formed of a groove-shaped indentation;

the nozzle hole which is formed at one end in a longitudinal direction of the groove-shaped indentation; and the fluid resistance section which is formed at the other end in the longitudinal direction of the groove-shaped indentation, and wherein the flow channel plate is deformed by pressing the flow channel plate in a thickness direction to form the pressure generating chamber, the nozzle hole, and the fluid resistance section.

2. The liquid ejection head as claimed in claim 1, wherein a portion at which the nozzle hole is formed is deformed further to a side in a liquid droplet ejection direction relative to a portion at which the pressure generating chamber is formed.

3. The image forming apparatus, comprising the liquid ejection head as claimed in claim 1.

4. A method of manufacturing the liquid ejection head claimed in claim 1, the method comprising the steps of:

pressing the thin plate to deform the pressed thin plate in a thickness direction;

forming the pressure generating chamber, the fluid resistance section, and a nozzle opening section that are formed of a groove-shaped indentation, inside of which nozzle opening section is formed a recess section to be the nozzle hole; and then polishing a tip portion of the nozzle opening section to open the nozzle hole.

5. The method of manufacturing the liquid ejection head as claimed in claim 4, wherein the groove-shaped indentation formed at the flow channel plate is formed by a half pierce process which stops press working partway.

6. The method of manufacturing the liquid ejection head as claimed in claim 4, wherein the groove-shaped indentation formed at the flow channel plate is formed by forging.

7. The method of manufacturing the liquid ejection head as claimed in claim 4, wherein the fluid resistance section, the pressure generating chamber and the nozzle opening section that are formed of the groove-shaped indentation are simultaneously formed by pressing.

8. The method of manufacturing the liquid ejection head as claimed in claim 4, further comprising:

a first step which presses, onto the thin plate, a punch shaped to be the pressure generating chamber and the fluid resistance section;

a second step which presses, to the thin plate, another punch which forms the nozzle hole to form he nozzle opening section, inside which nozzle opening section the recess section to be the nozzle hole is formed; and a third step which polishes the tip portion of the nozzle opening section formed in the second step, which tip portion projects to a face of the thin plate, onto which face a liquid droplet is to be discharged.

9. The method of manufacturing the liquid ejection head as claimed in claim 8, wherein the first step and the second step are forging which transfers a punch shape of the pressure generating chamber, the fluid resistance section, and the nozzle hole.

10. The method of manufacturing the liquid ejection head as claimed in claim 4, further comprising:

a first step which presses, onto the thin plate, a punch shaped to he the pressure generating chamber and the fluid resistance section;

a second step which polishes a face projecting to a face opposing a bottom face of the grove-shaped indentation formed by the pressing;

a third step which presses a punch which forms the nozzle hole to form the nozzle opening section, inside which nozzle opening section the recess section to be the nozzle hole is formed; and a fourth step which polishes the tip portion of the nozzle opening section formed in the third step to open the nozzle hole.

11. The method of manufacturing the liquid ejection head as claimed in claim 10 wherein the first step is HARP etching which forms the groove-shaped indentation by stopping the pressing of the thin plate by the press working partway.

12. A liquid ejection head including a flow channel plate, the flow channel plate being formed of a thin plate, the flow channel plate being formed with one or more p e generating chambers, a fluid resistance section which supplies liquid to the pressure generating, chamber, a nozzle hole which opposes the pressure generating chamber, and a holding member having a common liquid reservoir which supplies the liquid to the pressure generating chamber via the fluid resistance section, wherein the flow channel plate is made of a metal material, and wherein the flow plate comprises:

the pressure generating chamber which is formed of a groove-shaped indentation;

the nozzle hole which is formed at one end in a longitudinal direction of the groove-shaped indentation; and the fluid resistance section which is formed at the other end in the longitudinal direction of the groove-shaped indentation, and wherein the pressure generating chamber, the nozzle hole, and the fluid resistance section are formed such that they deform the flow channel plate in a thickness direction, and wherein the groove-shaped indentation extends to a location which opposes the common liquid reservoir provided at the holding member, and is connected to the common liquid reservoir via a communication port.

13. The liquid ejection head as claimed in claim 12, wherein, of wall faces of a flow channel from an inlet portion of the communication port to the nozzle hole, a wall face other than a wall face on a side at which an actuator unit is arranged which pressurizes the liquid within the pressure generating chamber is an inclined face which always has an inclination relative to a nozzle face and changes continuously.

14. A liquid ejection head, comprising:

a fluid channel member which forms one or more nozzles which eject a liquid droplet, a liquid chamber to which the nozzle communicates and a supplying channel which supplies liquid to the liquid chamber; and an actuator unit which pressurizes the liquid within the liquid chamber, wherein, of wall faces of the supplying channel from an inlet portion of the supplying channel to the nozzle, a wall face other than a wall face on a side at which the actuator unit is arranged is an inclined face which always has an inclination relative to a nozzle face and changes continuously.

15. The liquid ejection head as claimed in claim 14, wherein the wall face on the side at which the actuator unit is arranged is formed of a vibrating plate.

16. The liquid ejection head as claimed in claim 14, wherein the supplying channel, the liquid chamber, and the nozzle of the flow channel member are formed by press working.

17. The image forming apparatus, comprising the liquid ejection head as claimed in claim 14.

* * * * *